US006888459B2

(12) United States Patent
Stilp

(10) Patent No.: US 6,888,459 B2
(45) Date of Patent: May 3, 2005

(54) RFID BASED SECURITY SYSTEM

(76) Inventor: Louis A. Stilp, 1435 Byrd Dr., Berwyn, PA (US) 19312

( * ) Notice: Subject to any disclaimer, the term of this patent is extended or adjusted under 35 U.S.C. 154(b) by 56 days.

(21) Appl. No.: 10/356,512

(22) Filed: Feb. 3, 2003

(65) Prior Publication Data

US 2004/0150521 A1 Aug. 5, 2004

(51) Int. Cl.[7] ..... G08B 13/00

(52) U.S. Cl. ..... 340/541; 340/507; 340/508; 340/10.1; 700/79; 700/81

(58) Field of Search ..... 340/541, 572.1, 340/545.1, 506, 507, 539.14, 539.16, 539.17, 5.2, 5.1, 310.01, 825.36, 825.49, 10.1, 10.34, 539.22, 508, 5.61; 700/79, 80–82

(56) References Cited

U.S. PATENT DOCUMENTS 4,367,458 A * 1/1983 Hackett ..... 340/539.16
4,613,848 A * 9/1986 Watkins ..... 340/541
6,091,320 A * 7/2000 Odinak ..... 340/310.01
6,150,948 A * 11/2000 Watkins ..... 340/693.3
6,204,760 B1 * 3/2001 Brunius ..... 340/529
6,617,963 B1 * 9/2003 Watters et al. ..... 340/10.41
6,624,750 B1 * 9/2003 Marman et al. ..... 340/506
6,693,513 B2 * 2/2004 Tuttle ..... 340/10.1
2002/0060639 A1 * 5/2002 Harman ..... 342/28

* cited by examiner

*Primary Examiner*—Jeffrey Hofsass
*Assistant Examiner*—Eric Blount
(74) *Attorney, Agent, or Firm*—Stradley Ronon Stevens & Young, LLP

(57) ABSTRACT

A system and method for constructing a security system for a building using at least one RFID reader to communicate with at least one RFID transponder to provide the radio link between each of a number of openings and a controller capable of causing an alert in the event of an intrusion. The RFID transponder is connected to an intrusion sensor. The controller preferably communicates with the RFID reader using a power line communications protocol. The RFID transponder can contain a battery. The RFID reader contains means for transferring power to an RFID transponder for the purpose of charging any battery. The security system can contain more than one controller, whereby the RFID reader can communicate with more than one controller.

32 Claims, 11 Drawing Sheets

RFID BASED SECURITY SYSTEM

CROSS REFERENCE TO RELATED APPLICATIONS

Not Applicable

BACKGROUND OF THE INVENTION

Security systems are described in numerous patents, and have been in prevalent use for over 40 years. In the United States, there are over 14 million security systems in residential homes alone. The vast majority of these systems are hardwired systems, meaning the keypad, system controller, and various intrusion sensors are wired to each other. These systems are easy to install when a home is first being constructed and access to the interiors of walls is easy; however the cost increases substantially when wires must be added to an existing home. On average, the security industry charges approximately $75 per opening (i.e. window or door) to install a wired intrusion sensor (such as a magnet and reed switch). For this reason, most homeowners only monitor a small portion of their openings. In order to induce a homeowner to install a substantial system, many security companies will underwrite a portion of the costs of installing a security system. Therefore, if the cost of installation were $1,500 (i.e. approximately 20 windows and doors), the security company may only charge $500 and then require the homeowner to sign a multi-year contract with monthly fees. The security company then recovers its investment over time.

In order to reduce the labor costs of installing wired systems into existing homes, wireless security systems have been developed in the last 10 to 20 years. These systems use RF communications for at least a portion of the keypads and intrusion sensors. Typically, a transceiver is installed in a central location in the home. Then, each opening is outfitted with an intrusion sensor connected to a small battery powered transmitter. The initial cost of the wireless system averages $40 for each transmitter, plus the cost of the centrally located transceiver. This may seem less that the cost of a wired system, but in fact the opposite is true over a longer time horizon. Wireless security systems have demonstrated lower reliability than wired systems, leading to higher service and maintenance costs. For example, each transmitter contains a battery that drains over time (perhaps only a year or two), requiring a service call to replace the battery.

Many of these transmitters lose their programming when the battery dies, requiring reprogramming along with the change of battery. Further, in larger houses, some of the windows and doors may be an extended distance from the centrally located transceiver, causing the wireless communications to intermittently fade out.

These types of wireless security systems operate under 47 CFR 15.231(a), which places severe limits on the amount of power that can be transmitted. For example, at 433 MHz, used by the wireless transmitters of one manufacturer, a field strength of 11 mV/m is permitted at 3 meters. At 345 MHz, used by the wireless transmitters of another manufacturer, a field strength of 7.3 mV/m is permitted at 3 meters. Furthermore, control transmissions are only permitted once per hour, with a duration not to exceed one second. If these same transmitters wish to transmit data under 47 CFR 15.231(e), the field strengths at 345 and 433 MHz are reduced to 2.9 and 4.4 mV/m, respectively. (In a proceeding opened in October, 2001, the FCC is soliciting comments from the industry under which some of the rules of this section may change.) The problems of using these methods of transmission are discussed in various patents, including U.S. Pat. Nos. 6,087,933, 6,137,402, 6,229,997, 6,288,639, and 6,294,992. In addition, as disclosed in U.S. Pat. No. 6,026,165 since centrally located transceivers must have a long range (i.e. so as to attempt to reach throughout the house) this transceivers can also transmit and receive signals to/from outside the house and are therefore vulnerable to hacking by sophisticated intruders. Therefore, for the foregoing reasons and others, a number of larger security monitoring companies strongly discourage the use of wireless security systems.

In either wired or wireless prior art security systems, additional sensors such as glass breakage sensors or motion sensors are an additional cost beyond a system with only intrusion sensors. Each glass breakage or motion sensor can cost $50 or more, not counting the labor cost of running wires from the alarm panel to these sensors. In the case of wireless security systems, the glass breakage or motion sensor can also be wireless, but then these sensors suffer from the same drawbacks as the transmitters used for intrusion sensing—they are battery powered and therefore require periodic servicing to replace the batteries and reprogram in the event of memory loss.

Because existing wireless security systems are not reliable and wired security systems are difficult to install, many homeowners forego self-installation of security systems and either call professionals or do without. It is interesting to note that, based upon the rapid growth of home improvement chains such as Home Depot and Lowe's, there is a large market of do-it-yourself homeowners that will attempt carpentry, plumbing, and tile—but not security. There is, therefore, an established need for a security system that is both reliable and capable of being installed by the average homeowner.

RFID technology has been in existence for over 40 years, with substantial development by a number of large companies. A search of the USPTO database will reveal several hundred RFID-related patents. Surprisingly, a number large companies such as Micron and Motorola have exited the RFID business as the existing applications for RFID have not proved lucrative enough. Most development and applications for RFID technology have been targeted at moveable items—things, people, animals, vehicles, merchandise, etc.—that must be tracked or counted. Therefore, RFID has been applied to animal tracking, access control into buildings, inventory management, theft detection, toll collections (i.e. EZPass), and library and supermarket checkout. In each of the applications, the low-cost RFID transponder or "tag" is affixed to the moveable object, and the RFID reader is generally a much higher cost transceiver. The relative high cost (hundreds to thousands of dollars) of RFID readers is due to the requirement that it perform reliably in each mobile application. For example, the RFID reader for a toll collection application must "read" all of the tags on cars traveling 40 MPH. Similarly, access control must read a large number of tags in a brief period of time (perhaps only hundreds of milliseconds) while people are entering a building. Or a portable RFID reader must read hundreds or thousands of inventory tags simultaneously while the operator is walking around a warehouse. Each of these applications can be fairly demanding from a technical standpoint, hence the need for sophisticated and higher cost readers. To date, RFID technology has not been applied to the market for security systems in homes or businesses.

It is therefore an object of the present invention to provide security systems for use in residential and commercial buildings that can be self-installed or installed by professionals at much lower cost than present systems. It is a further object of the present invention to provide a combination of RFID transponders and RFID readers that can be used in a security system for buildings.

BRIEF SUMMARY OF THE INVENTION

The present invention is a highly reliable system and method for constructing a security system for a building using a novel approach to designing RFID readers and RFID transponders to provide the radio link between each of a number of openings and a controller capable of causing an alert in the event of an intrusion.

The present invention improves upon the traditional system model and paradigm by providing a security system with reliability exceeding that of existing wireless security systems, at lower cost than either professionally installed hardwired systems or wireless security systems. Furthermore, the present invention allows self-installation by typical homeowners targeted by the major home improvement chains.

Several new marketing opportunities are created for security systems that are otherwise unavailable in the market today. First, for professional systems sold by major alarm companies, a single customer service representative may sell the system to a homeowner and then install the system in a single visit to the customer's home. This is in contrast to the present model where a salesperson sells the system and then an installer must return at a later date to drill holes, pull wires, and otherwise install the system. Second, homeowners may purchase the inventive system at a home improvement chain, self-install the system, and contract for alarm monitoring from an alarm services company. The overall system cost is lower, and the alarm services company is not required to underwrite initial installation costs, as is presently done today. Therefore, the alarm services company can offer monitoring services at substantially lower prices. Third, a new market for apartment dwellers opens up. Presently, very few security systems are installed in apartments because building owners are unwilling to permit the drilling of holes and installation of permanent systems. Apartment dwellers are also more transient than homeowners and therefore most apartment dwellers and alarm service companies are unwilling to underwrite the cost of these systems anyway. The inventive system is not permanent, nor is drilling holes for hardwiring required. Therefore, an apartment dweller can purchase the inventive security system, use it in one apartment, and then unplug and move the system to another apartment later.

The improvements provided by the present invention are accomplished through the following innovations. The first innovation is the design of a low cost RFID reader that can be installed into an outlet and cover an area the size of a large room in the example of a house. Rather than rely on the centrally located transceiver approach of existing unreliable wireless security systems, the present invention places the RFID reader into each room for which coverage is desired. The RFID reader has a more limited range than the centrally located transceiver, and is therefore less susceptible to hacking by sophisticated intruders. For the example of smaller to medium sized houses, a single RFID reader may be able to cover more than one room. Furthermore, the presence of multiple RFID readers within a building provides spatial receiver diversity.

The second innovation is the use of an RFID transponder for each covered opening. As is well known there is at least an order of magnitude difference in the manufacturing costs of RFID transponders versus present wireless security system transmitters. This i due both to difference in design, as well as manufacturing volumes of the respective components used in the two different designs.

The third innovation is the provision of a circuitry in both the RFID reader and the RFID transponder for the charging of any battery required in the RFID transponder. For some installations, a battery may be used in the RFID transponder to increase the range and reliability of the RF link between reader and transponder. The present problem of short battery life in wireless security system transmitters is overcome by the transfer of power through radio waves. The RFID reader receivers its power from standard AC outlets, and converts some of this power into RF energy, which can then be received by the RFID transponder and used for battery charging.

The fourth innovation is the status monitoring of the need for battery charging. The RFID transponder can indicate the RFID reader when power for charging is required. If desired, the RFID reader can shut off its transmitter if no power transfer is required, thereby reducing RF emissions and any possible interference.

The fifth innovation is the use of power line carrier communications between the RFID readers and one or more controllers. While the RFID readers can also be hardwired to a controller, a significant installation cost advantage is obtained by allowing the RFID readers to "piggyback" on the standard AC power lines already in the building. By using the power line carrier connection technique, an example homeowner can simple plug in the controller to a desired outlet, and plug in the RFID readers in an outlet in the desired covered rooms, and the system is ready to begin monitoring RFID transponders.

The sixth innovation is the optional inclusion of a glass breakage or motion sensor into the RFID reader. In many applications, an RFID reader will be likely be installed into each major room of a house, using the same example throughout this document. Rather than require a separate glass breakage or motion sensor as in prior art security systems, a form of the RFID reader includes a glass breakage or motion sensor within the same integrated package, providing a further reduction in overall system cost when compared to prior art systems.

The seventh innovation is the permitted use of multiple controllers in the security system. In the present invention, the controller will typically also be the keypad for the security system. Therefore, a homeowner or building owner installing multiple keypads will also simultaneously be installing multiple controllers. The controllers operate in a redundant mode with each other. Therefore, if an intruder discovers and disables a single keypad, the intruder may still be detected by the any of the remaining installed controllers.

The eighth innovation is the permitted optional use of either the traditional public switched telephone network (i.e. PSTN—the standard home phone line) or the integrated use of a commercial radio mobile service (CMRS) such as a TDMA, GSM, or CDMA wireless network for causing an alert at an emergency response agency such as an alarm service company. In particular, the use of a CMRS network provides a higher level of security, and a further ease of installation. The higher level of security results from (i) reduced susceptibility of the security system to cuts in the wires of a PSTN connection, and (ii) optional use of messaging between the security system and an emergency response agency such that any break in the messaging will in itself cause an alert.

Additional objects and advantages of this invention will be apparent from the following detailed description.

DETAILED DESCRIPTION OF THE INVENTION

The present invention is a highly reliable system and method for constructing a security system for use in a building, such as a commercial building, single or multi-family residence, or apartment. The security system may also be used for buildings that are smaller structures such as sheds, boathouses, other storage facilities, and the like.

Figure 1:
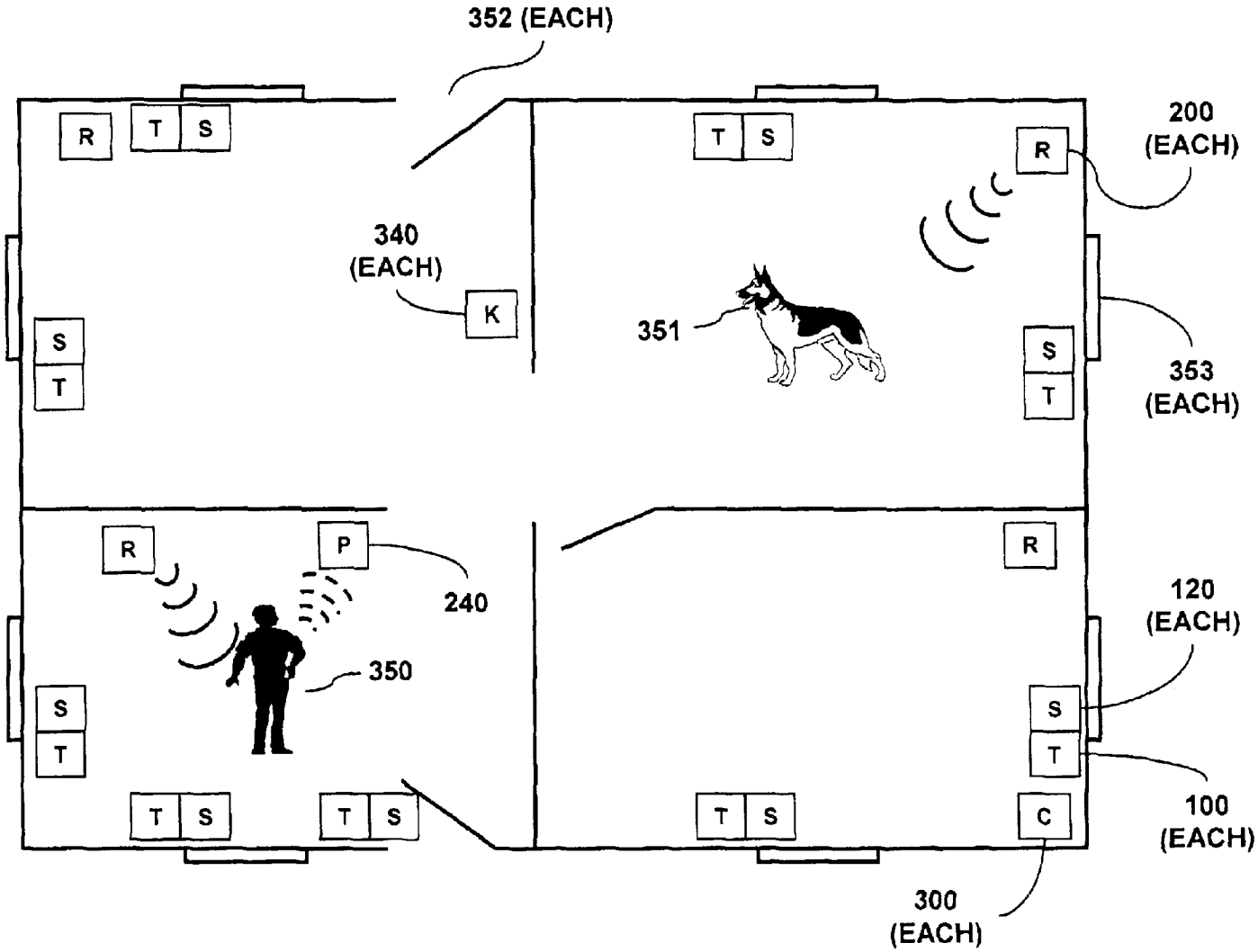
FIG. 1 shows the distributed manner in which the present invention would be installed into an example house.
Figure 2:
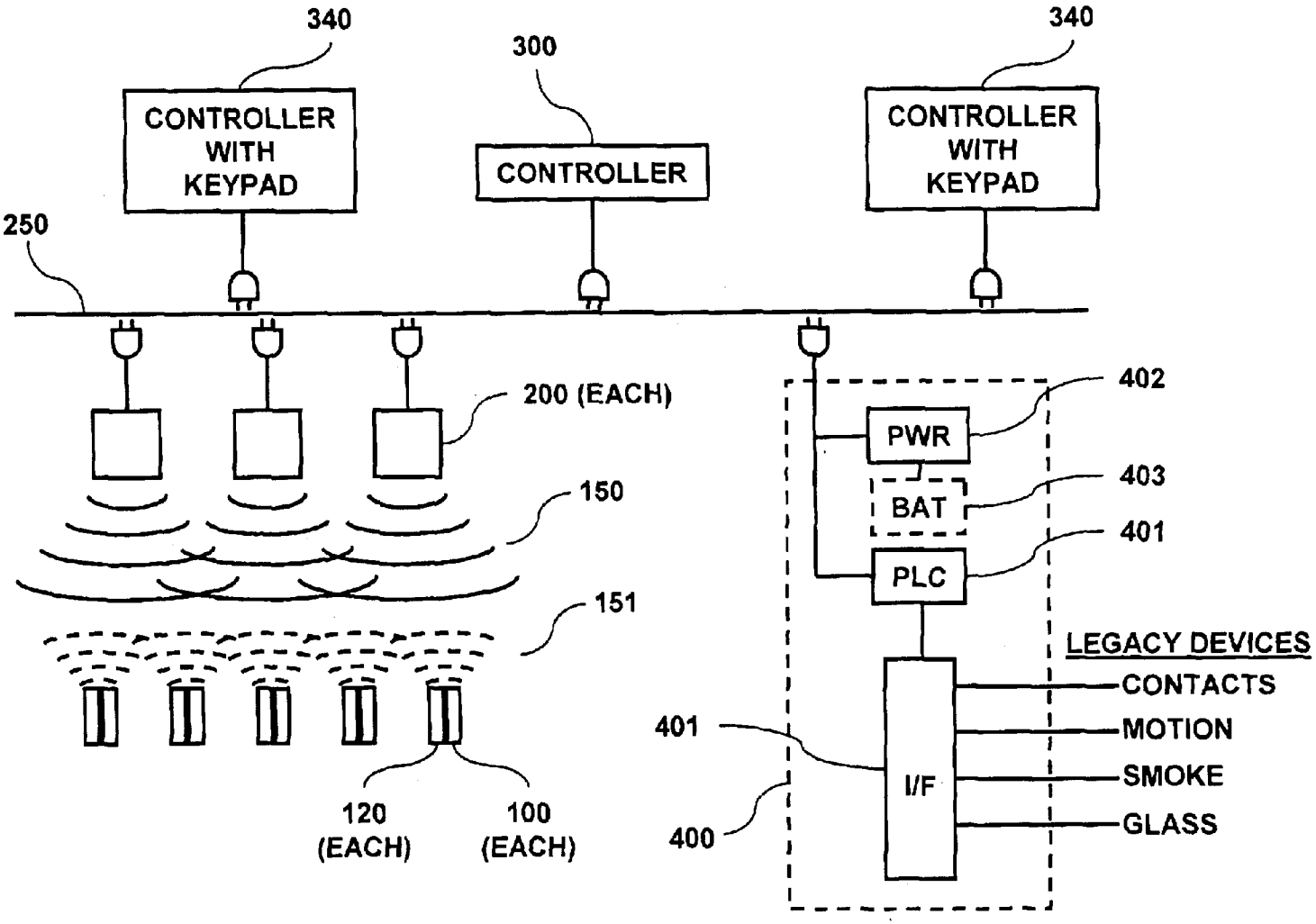
FIG. 2 shows exemplary communications relationships between various elements of the present invention.

There are 4 primary parts to the security system: an intrusion sensor 120, an RFID transponder 100, an RFID reader 200, and a controller 300. FIG. 1 shows an example of the layout for a small house and FIG. 2 shows the general architecture of the security system. At each opening in the house, such as windows 353 and doors 352, for which monitoring is desired, an intrusion sensor 120 and RFID transponder 100 are mounted. In approximately each major room of the house, an RFID reader 200 is mounted. Each RFID reader 200 is in wireless communications with one or more RFID transponders 100. In general, each RFID reader 200 is responsible for the RFID transponders 100 in the room associated with each RFID reader 200. However, as is well understood to those skilled in the art, the range of wireless communications is dependent, in part, upon many environmental factors in addition to the specific design parameters of the RFID readers 200 and RFID transponders 100. It is likely, in the average American home, that most RFID readers 200 will not only be able to communicate with RFID transponders 100 in the same room as the RFID reader 200, but also with RFID transponders 100 in other rooms. Therefore, in many cases with this system it will be possible to either install fewer RFID readers 200 than major rooms in a building, or to follow the guideline of one RFID reader 200 per major room, creating a system with excellent spatial antenna diversity as well as redundancy in the event of single component failure. The RFID reader 200 obtains its power from a nearby standard AC power outlet 230. In fact, the preferred packaging of the RFID reader 200 has the plug integrated into the package such that the RFID reader 200 is plugged into a standard outlet 230 without any associated extension cords, power strips, or the like.

At least one controller 300 is required in each security system, but in many cases it will increase the convenience of the homeowner or occupants of the building to have more than one controller 300. Many traditional hardwired security systems have separate alarm panels and keypads. The alarm panel contains the controller for the system while the keypad is a relatively dumb remote access device. This is due, in part, to the requirement that the alarm panel contain a relatively bulky lead acid battery to power the electronics of the alarm panel, the keypads, and various sensors such as motion detectors and glass breakage detectors. Therefore, the alarm panel is typically hidden in a closet to hide the bulkiness of the panel while only the smaller, more attractive keypad is visibly mounted on a wall. The controller 300 of the present invention does note require a lead acid battery because the controller 300, the RFID readers 200, and other associated sensors are each powered locally. The controller 300 obtains its power from a nearby standard AC power outlet.

Figure 3:
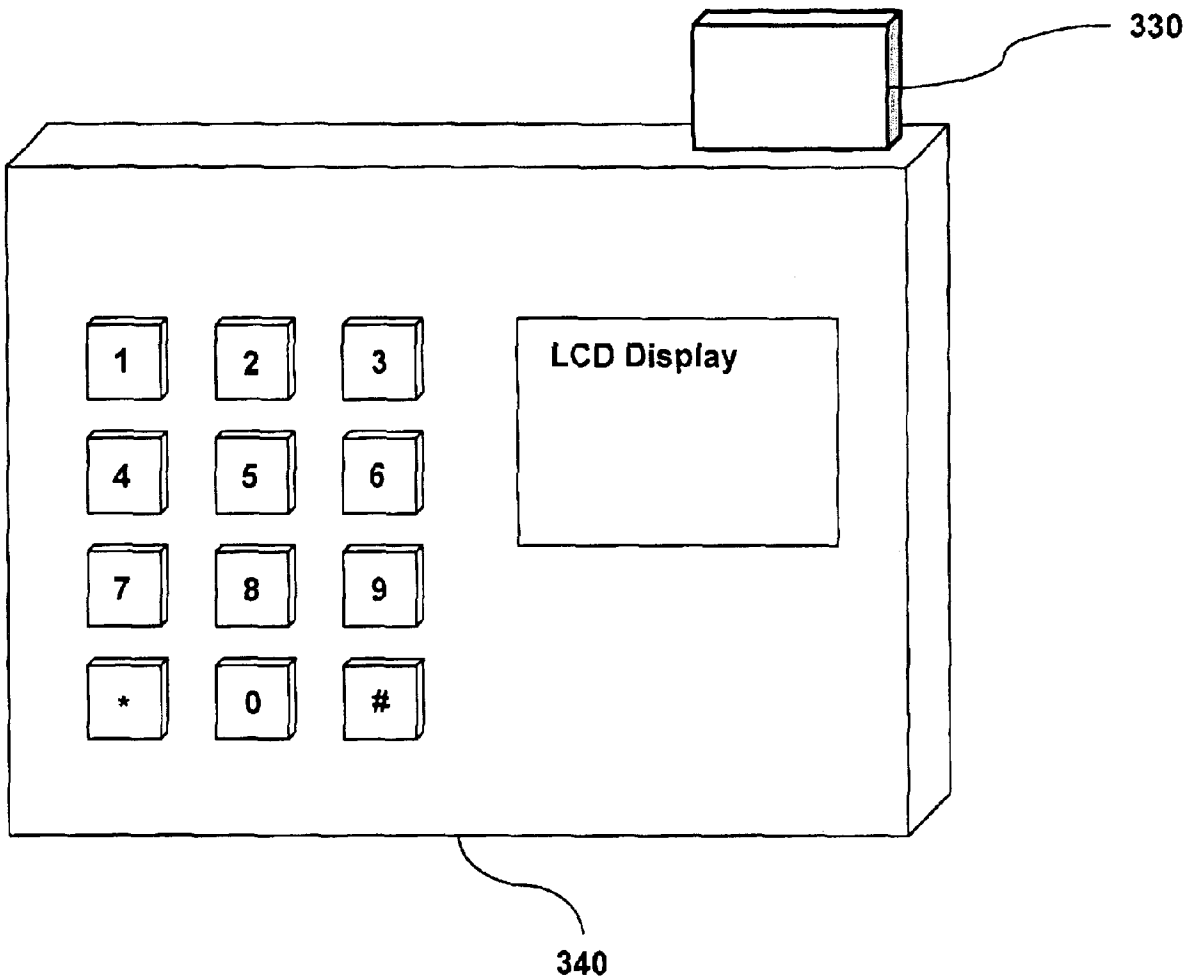
FIG. 3 shows an example embodiment of a controller with integrated keypad and display.
Figure 4B:
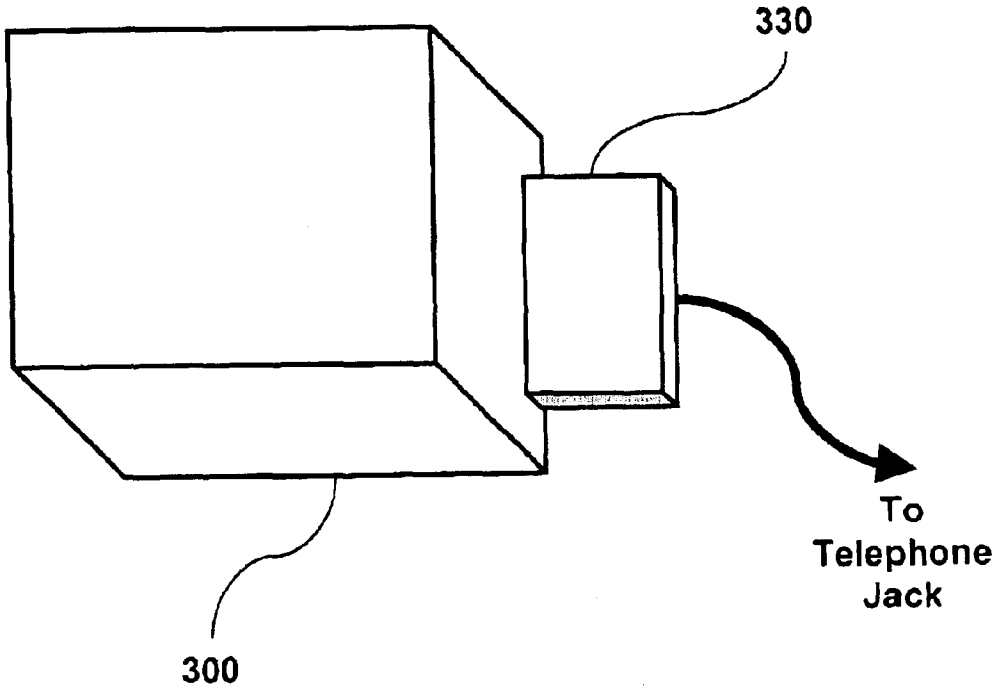
FIG. 4B shows an example embodiment of a controller without keypad.

The controller 300 of the present invention is illustrated in two exemplary forms. The first form 340, shown in FIG. 3, includes an integrated user interface in the form of a keypad 320 and display 321, and the second form, shown in FIG. 4B does not include a keypad 320 or display 321. The controller 300 typically contains the following major logic functions:

- configuration of the security system whereby each of the other components are identified and placed under control of the controller 300,
- receipt and interpretation of daily operation commands executed by the homeowner or building occupants including commands whereby the system is placed into monitoring mode or deactivated for normal building use,
- communications with other controllers 300, if present, in the system including exchange of configuration information and daily operation commands as well as arbitration between the controllers 300 as to which controller 300 shall be the master controller,
- communications with RFID readers 200 in the system including the sending of various commands and the receiving of various responses and requests,
- processing and interpretation of data received from the RFID readers 200 including data regarding the receipt of various signals from the sensors and RFID transponders 100 within read range of each RFID reader 200,
- monitoring of each of the sensors, both directly and indirectly, to determine whether a likely intrusion has occurred, whether glass breakage has been detected, or whether motion has been detected,
- deciding, based upon the configuration of the system and the results of monitoring activity conducted by the controller 300, whether to cause an alert,
- causing an alert, if necessary, by some combination of audible indication, dialing through the public switched telephone network (PSTN) 373 to deliver a message to an emergency response agency, or sending a message through one or more commercial mobile radio service (CMRS) 370 operators to an emergency response agency 374.

If the homeowner or building owner installs only a single controller 300 in a security system of the present invention, then the controller 300 will likely include an integrated keypad 320. In this case, the controller 300 will take the form 340 shown in FIG. 3. The controller's size and shape, in this case, are dictated by the ergonomics of providing a keypad 320 with tactile feedback and an LCD-based display 321 by which the controller 300 can display messages and the results of commands and operations for viewing by the homeowner or building owner. The controller 300 with keypad 320 can be mounted, for example, onto the type of electrical box used for light switches.

Figure 5:
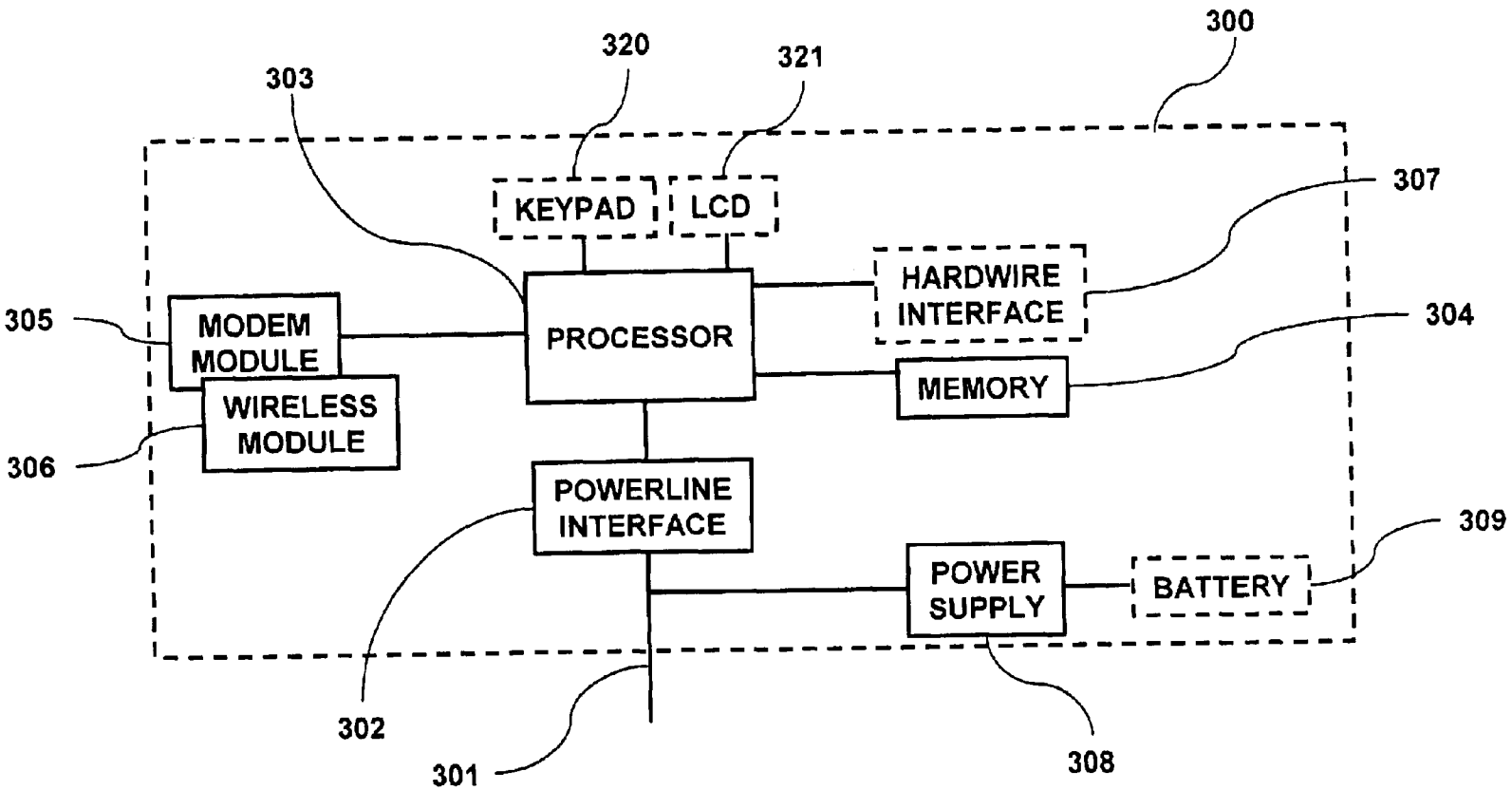
FIG. 5 shows the architecture of the controller.
Figure 6:
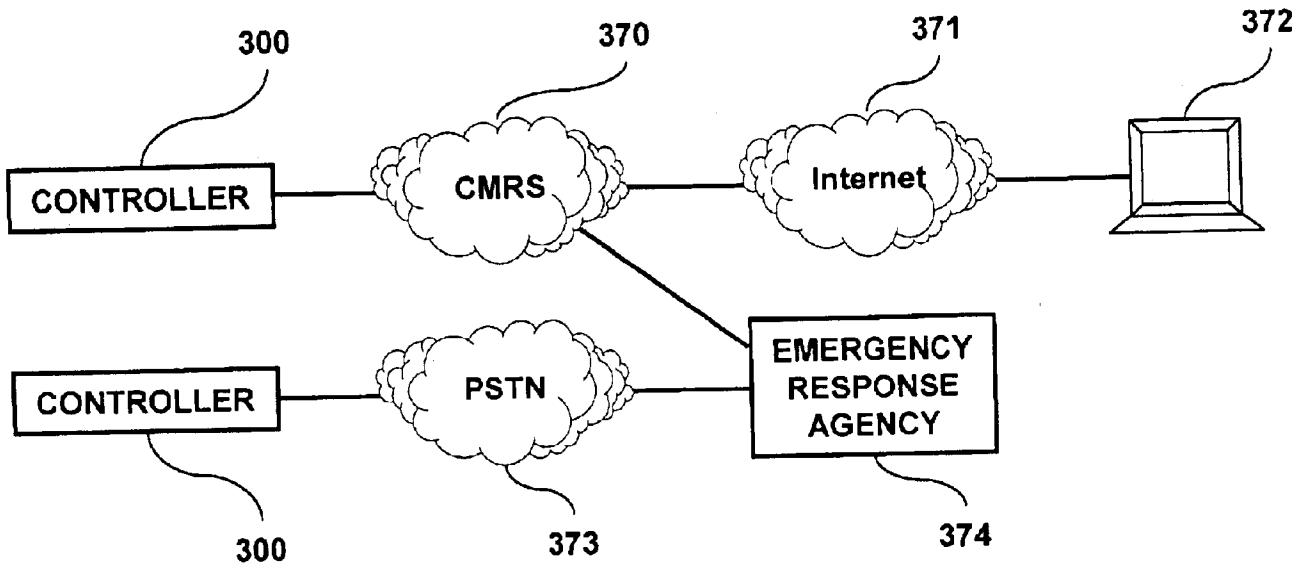
FIG. 6 shows the communications relationships between the controllers and various external networks and entities.

A block diagram of the controller 300 is shown in FIG. 5. The major logic functions are implemented in the firmware or software executed by the microprocessor 303 of the controller 300. The microprocessor 303 contains non-volatile memory 304 for storing the firmware or software as well as the configuration of the system. The controller 300 has its own power supply 308 and can also contain a backup battery 309, if desired, for use in case of loss of normal power. If the homeowner or building owner installs a second (or more) controller 300 in a security system of the present invention, then the second controller 300 can either include an integrated keypad 320 or it can include only the controller 300 functions without a keypad. The controller 300 without a keypad can take the form shown in FIG. 4B.

With or without the keypad 320, a second controller 300 can still serve to function as an alternate or backup controller 300 for cases in which the first controller 300 fails, such as component failure, disablement or destruction by an intruder, or loss of power at the outlet where the first controller 300 is plugged in. Loss of power can occur if the breaker for that power circuit "trips" causing the circuit to be disconnected from the rest of the building. In this "tripping" scenario, even the presence of a battery backup 309 will not help the situation since the controller's communications can be disconnected from the other security system components if power line carrier communications is being used. Therefore, the use of this second controller 300 can be of high value to the building owner, especially if the second controller 300 is located on a separate power circuit from the first controller 300.

The controller 300 will typically communicate with the RFID readers 200 using a power line carrier protocol 302. The homeowner or building owner receives maximum benefit of this inventive security system by avoiding the installation of additional wires. Power line carrier protocols allow the sending of data between devices using the existing power lines 250 in a building. One of the first protocols for doing this is known as the X-10 protocol. However, there are now a number of far more robust protocols in existence. One such protocol is known as CEBus (for Consumer Electronics Bus), which was standardized as EIA600. There are a growing number of other developers of power line carrier protocols such as Easyplug/Inari, Itran Communications, and nSine. For the inventive security system, the primary driver for deciding upon a particular power line carrier protocol is the availability of chipsets, reference designs, and related components at high manufacturing volumes and at low manufacturing cost. Furthermore, compatibility with other products in the home automation field would be an additional advantage. For these reasons and others, the inventive security system presently uses the Intellon chipset INT51X1, which implements the standardized protocol known as HomePlug. This particular chipset offers Ethernet type data speeds over standard power lines 250 at a reported distance of up to 300 meters. The HomePlug standard operates using frequencies between 4.3 and 20.9 MHz, and includes security and encryption protocols to prevent eavesdropping over the power lines 250 from adjacent houses or buildings. The specific choice of which protocol to use is at the designer's discretion, and does not subtract from the inventiveness of this system.

For various reasons, it is also possible that a particular building owner will not desire to use power line communications. For example, the occupants of some buildings may be required to meet certain levels of commercial or military security that preclude permitting signals on power lines that might leak outside of the building. Therefore a form of the controller 300 may also be configured to use hardwired connections through a hardwire interface 307 with one or more RFID readers 200.

Homeowners and building owners generally desire one or two types of alerts in the event that an intrusion is detected. First, an audible alert may be desired whereby a loud siren is activated both to frighten the intruder and to call attention to the building so that any passers-by may take notice of the intruder or nay evidence of the intrusion. However, there are also scenarios in which the building owner prefers the so called silent alert whereby no audible alert is made so as to lull the intruder into believing he has not been discovered and therefore may still be there when law enforcement personnel arrive. The second type of alert is messaging an emergency response agency 374, indicating the detection of an intrusion and the identity of the building. The emergency response agency 374 may be public or private, depending upon the local customs, and so, for example, may be an alarm services company or the city police department.

The controller 300 of the inventive system supports the second type of foregoing alert by including a slot capable of receiving an optional module 305/306. This module 305/306 is preferably in the form of an industry standard compact flash module 330, thereby allowing the selection of any of a growing variety of modules made by various vendors manufactured to this standard. The module may either be a modem module 305 for connection to a public switched telephone network (PSTN) 373 or a wireless module 306 for connection to a commercial mobile radio service (CMRS) network 370 such as any of the widely available CDMA, TDMA, or GSM-based wireless networks. If the building owner has selected power line carrier as the means for the controller 300 to communicate with the RFID reader 200, then the controller 300 can also communicate with a power line phone module such as the GE TL-96596/7 or Phonex PX-441/2 families, among others. The use of the power line phone module allows the connection to the PSTN 373 to be in a different location than that controller 300, if desired.

Certain building owners will prefer the higher security level offered by sending an alert message through a CMRS 370 network. The use of a CMRS network 370 by the controller 300 overcomes a potential point of failure that occurs if the intruder were to cut the telephone wires prior to attempting an intrusion. If the building owner has installed at least two controllers 300 in the system, one controller 300 can have a wireless module 306 installed and a second can have a modem module 305 installed. This provides the inventive security system with two separate communication paths for sending alerts to the emergency response agency. By placing the controllers 300 in very different location in the building, the building owner significantly decreases the likelihood that an intruder can discover and defeat the security system.

The controller 300 offers an even higher level of security that is particularly attractive to marketing the inventive security system to apartment dwellers. Historically, security systems of any type have not been sold and installed into apartments for several reasons. Apartment dwellers are more transient than homeowners, making it difficult for the dweller or an alarm services company to recoup an investment in installing a system. Of larger issue, though, is the small size of apartments relative to houses. The smaller size makes it difficult to effectively hide the controller, making it vulnerable to discovery and then disconnection or destruction during the pre-alert period. The pre-alert period of any security system is the time allowed by the controller for the normal homeowner to enter the home and disarm the system by entering an appropriate code or password into a keypad. This pre-alert time is often set to 30 seconds to allow for the fumbling of keys, the carrying of groceries, the removal of gloves, etc. In an apartment scenario, 30 seconds is a relatively long time in which an intruder can search the apartment seeking the controller and then preventing alert. Therefore, security systems have not been considered a viable option for most apartments. Yet, at least 35% of the households in the U.S. live in apartments and their security needs are not less important than those of homeowners.

The inventive security system includes an additional remote monitoring function in the controller 300, which can be selectively enabled at the discretion of the system user, for use with the wireless module. Beginning in 2001, most CMRS 370 networks based upon CDMA, TDMA, or GSM have supported a feature known as two-way Short Messaging Service (SMS). Available under many brand names, SMS is a connectionless service that enables the sending of short text messages between a combination of wireless and/or wired entities. The controller 300 includes a function whereby the controller 300 can send a message, via the wireless module 306 and using the SMS feature of CMRS 370 networks, to a designated processor at an alarm services company, or other designated location, at the time that a pre-alert period begins and again at the time that the security system has been disabled by the normal user, such as the apartment dweller, by entering the normal disarm code. Furthermore, the controller 300 can send a different message, via the wireless module 306 and using the SMS feature of CMRS networks 370, to the same designated processor if the normal user enters an abnormal disarm code that signals distress, such as when, for example, an intruder has forced entry by following the apartment dweller home and using a weapon to force the apartment dweller to enter her apartment with the intruder and disarm the security system.

Figure 7:
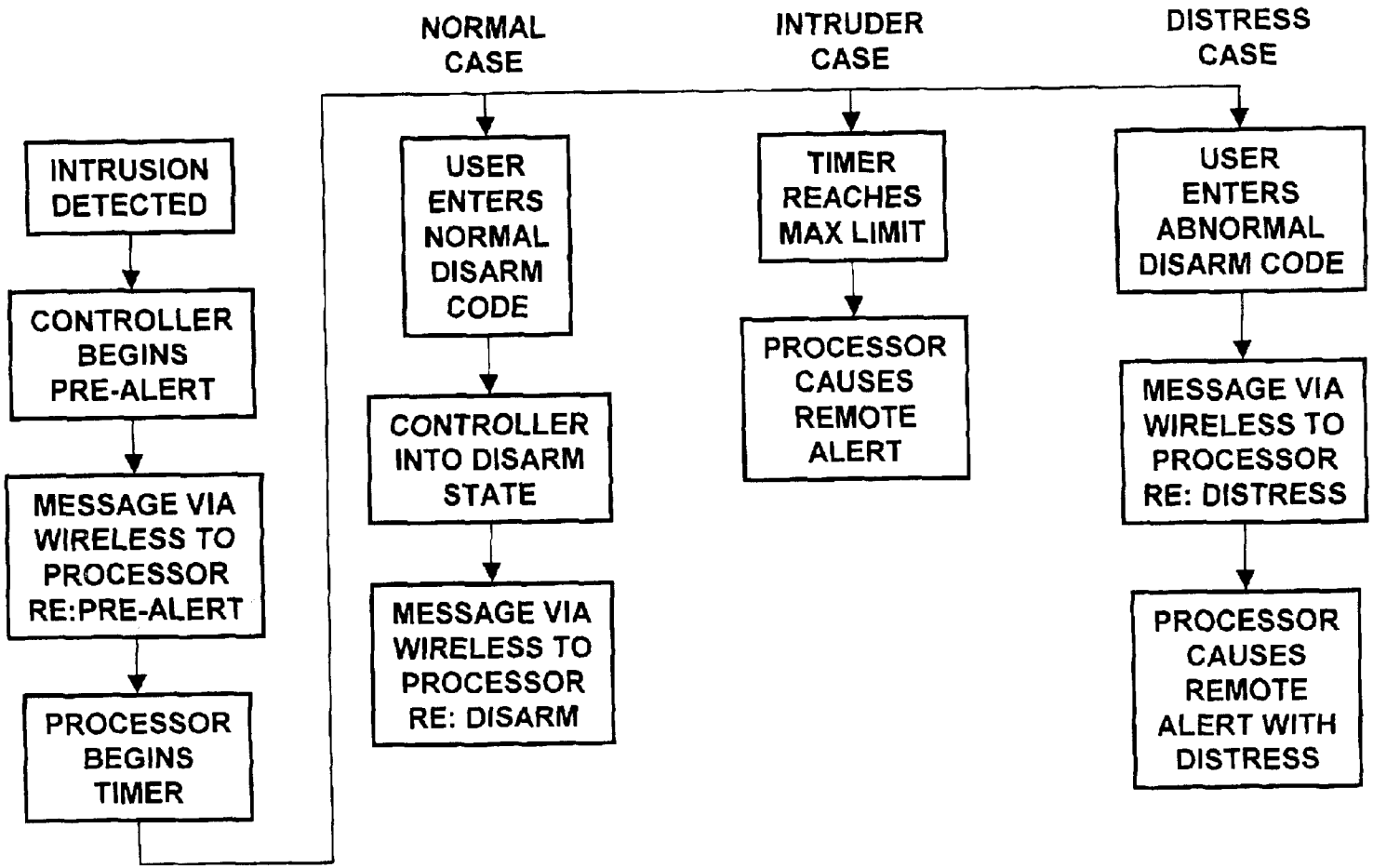
FIG. 7 is a flow chart for a method of providing a remote monitoring function.

In logic flow format, the remote monitoring function operates as shown in FIG. 7 and described in more detail below, assuming that the function has been enabled by the user:

An intrusion is detected in the building, such as the apartment, the controller 300 begins a pre-alert period, the controller 300 sends a message via the wireless module 306 to the designated processor that is remotely monitoring security systems, whereby the message indicates the identity of the security system and the transition to pre-alert state, the designated processor begins a timer (for example 30 seconds or any reasonable period allowing for an adequate pre-alert time), if the person causing the intrusion is a normal user under normal circumstances, the normal user will enter the normal disarm code, the controller 300 ends the pre-alert period, and enters a disarmed state, the controller 300 sends a message via the wireless module 306 to the designated processor, whereby the message indicates the identity of the security system and the transition to disarm state, if the person causing the intrusion is an intruder who does not know the disarm code and/or disables and/or destroy the controller(s) 300 of the security system, the timer at the designated processor reaches the maximum time limit (30 seconds in this example) without receiving a message from the controller 300 indicating the transition to disarm state, the designated processor remotely causes an alert indicating that an intrusion has taken place at the location associated with the identity of the security system, if the person causing the intrusion is a normal user under distressed circumstances (i.e. gun to back), the normal user will enter an abnormal disarm code indicating distress, the controller 300 sends a message via the wireless module 306 to the designated processor, whereby the message indicates the identity of the security system and the entering of an abnormal disarm code indicating distress, the designated processor remotely causes an alert indicating that an intrusion has taken place at the location associated with the identity of the security system and that the normal user is present at the location and under distress.

As can be readily seen, this inventive remote monitoring function now enables the installation of this inventive security system into apartments without the historical risk that the system can be rendered useless by the discovery and disablement or destruction by the intruder. With this function enabled, even if the intruder were to disable or destroy the system, a remote alert would still be signaled because a message indicating a transition to disarm state would not be sent, and a timer would automatically conclude remotely at the designated processor.

With the wireless module 306 installed, a controller 300 can also be configured to send an SMS-based message through the CMRS 370 and the Internet 371 to any email address based upon selected user events. For example, an individual away from home during the day may want a message sent to his pager, wireless phone, or office email 372 if the inventive security system is disarmed at any point during the day when no one is supposed to be at home. Alternately, a parent may want a message sent when a child has retuned home from school and disarmed the security system. Perhaps a homeowner has provided a temporary disarm code to a service company scheduled to work in the home, and the homeowner wants to receive a message when the work personnel have arrived and entered the home.

With the modem module 305 or the wireless module 306 installed, the controller 300 can receive updated software or parameters, or remote commands. The controller 300 can also report periodic status and/or operating problems detected by the system to the emergency response agency 374 or to the manufacturer of the system.

When there are multiple controllers 300 installed in a single security system, the controllers 300 arbitrate among themselves to determine which controller 300 shall be the master controller for a given period of time. The preferred arbitration scheme consists of a periodic self-check by each controller 300, and the present master controller may remain the master controller as long as its own periodic self-check is okay. If the present master controller fails its self-check, and there is at least one other controller 300 whose self-check is okay, the failing master controller will abdicate and the other controller 300 whose self-check is okay will assume the master role. In the initial case or subsequent cases where multiple controllers 300 (which will be ideally be the usual case) are all okay after periodic self-check, then the controllers 300 may elect a master controller from among themselves by each choosing a random number from a random number generator, and then selecting the controller 300 with the lowest random number. There are other variations of arbitration schemes that are widely known, and any number are equally useful without deducting from the inventiveness of permitting multiple controllers 300 in a single security system, as long as the result is that in a multi-controller 300 system, no more than one controller 300 is the master controller at any one time. In a multi-controller system, one controller 300 is master controller and the remaining controllers 300 are slave controllers, keeping a copy of all parameters, configurations, and status but not duplicating the actions of the master controller.

Figure 8A:
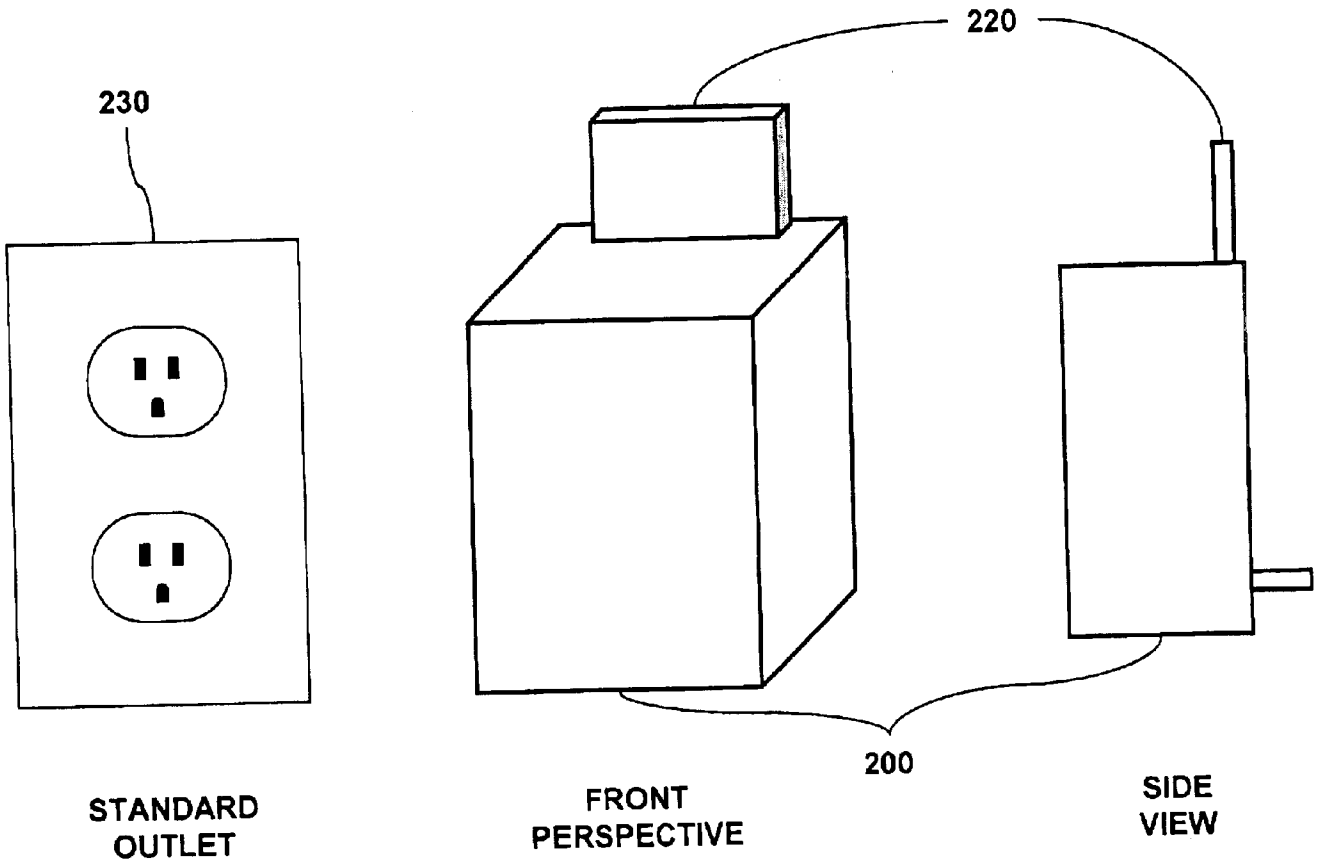
FIG. 8A shows an example embodiment of an RF reader without an acoustic transducer, and in approximate proportion to a standard power outlet.
Figure 9:
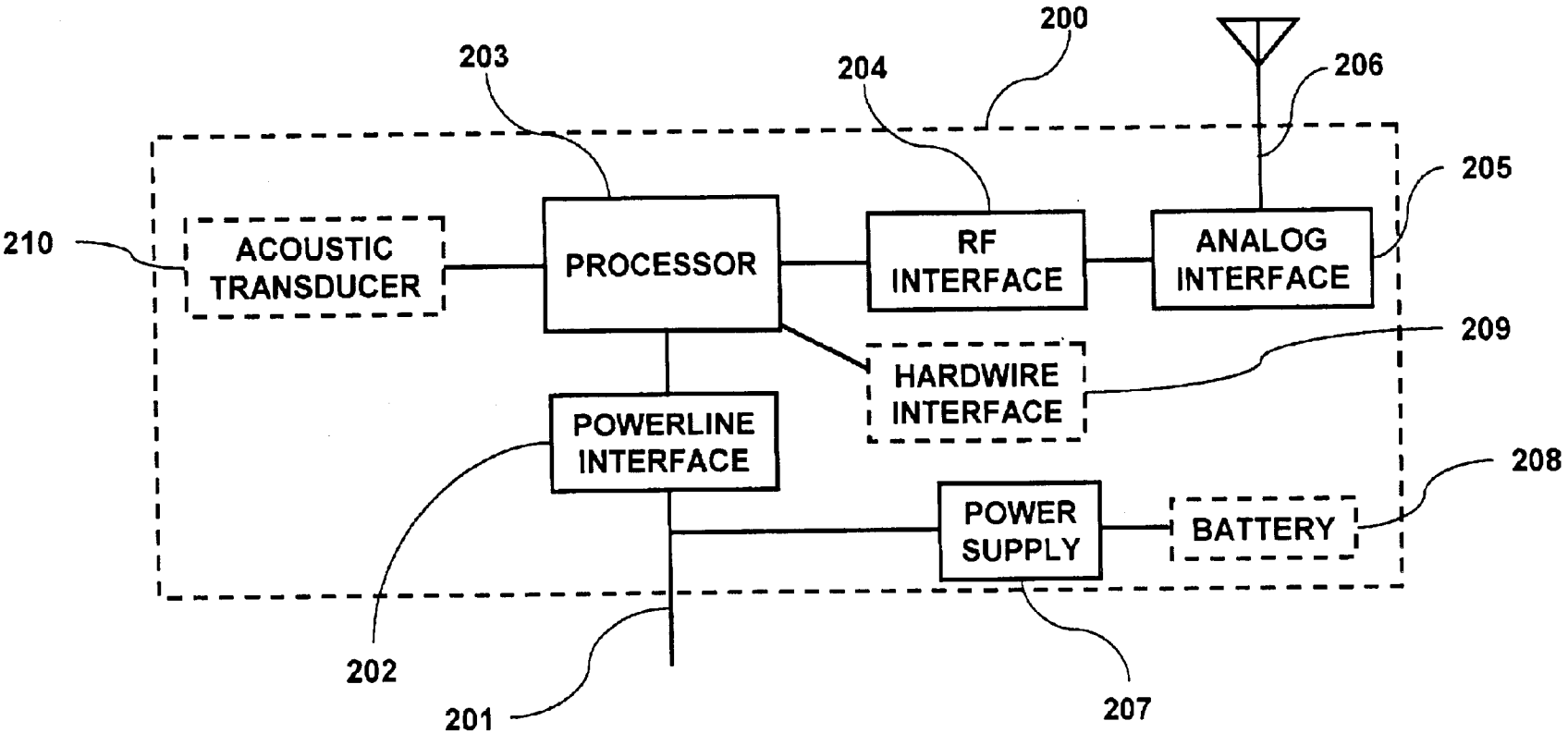
FIG. 9 shows the architecture of the RF reader.

The RFID reader 200 is typically designed to be inexpensively manufactured since in each installed security system, there may be approximately one RFID reader 200 for each major room to be monitored. In a typical embodiment, the RFID reader 200 is constructed in the form factor approximating the length and width dimensions of a standard wall outlet cover 230. FIG. 8A shows the present size of the RFID reader 200, which is approximately 3" by 4" by 2". FIG. 9 shows a block diagram of the RFID reader 200 with a microprocessor 203 controlling transmission and receive functions through an RF interface 204 chipset, an analog interface 205, and antenna 206. The RFID reader 200 has been constructed as one PC motherboard containing most of the components, with a slot for accepting a daughter card in the form factor of an industry standard compact flash module 220. This module size is preferred because the growing variety of modules made by various vendors and manufactured to this standard are leading to rapidly declining component and manufacturing costs for chipsets, discrete resistors, capacitors, inductors, antennas, packaging, and the like. It is not a requirement of this invention that the RFID reader 200 be constructed in these two parts (motherboard plus daughterboard); rather it is a present designer's choice because of the belief that the choice will produce low manufacturing costs. It is likely that variations of the RFID reader 200 can also be produced with all components integrated into a single package, perhaps even smaller in size, without detracting from the present inventive architecture and combination of function, circuits, and logic. The present size of the RFID reader 200 is actually dictated by the size of the chosen Microtran transformer used in the power supply 207 circuits. The packaging of the RFID reader 200 also permits the installation of a battery 208 for backup purposes in case normal power supply is interrupted.

The RFID reader 200 will typically communicate with the RFID transponders 100 using frequencies in one or both of two unlicensed bands: the 902 to 928 MHz band and the 2.435 to 2.465 GHz band. These bands permit the use of unlicensed secondary tranmitters, and are part of the bands that have become popular for the development of cordless phones and wireless LAN networks, thereby leading to the wide availability of many low cost components required, such as the RF interface 204 chips, analog interface 205 components, and antennas 206.

Transmissions in this portion of the band are regulated by FCC rules 47 CFR 15.245, which permit field strengths of up to 500 mV/m at 3 meters. Furthermore, transmissions in this band do not suffer the same duty cycle constraints as existing wireless security system transmitters operating under 47 CFR 15.231(a). However, in order to use the rules of 47 CFR 15.245, the RFID reader 200 must operate as a field disturbance sensor, which it does. Existing wireless security system transmitters are not field disturbance sensors.

Most other products using these unlicensed bands are other transient transmitters operating under 47 CFR 15.247 and 47 CFR 15.249, and so even though it may seem that many products are available and in use in these bands, in reality there remains a lot of available space in the band, especially in residential homes. In most cases, the RFID readers 200 can operate without incurring interference or certainly without significant interference.

As discussed in the foregoing section on the controller 300, the preferred means of communications between the RFID reader 200 and the controller 300 is using a power line carrier protocol 202. This means of communications permits the homeowner or building owner to install the RFID readers 200 by simply plugging each into an outlet 230 in approximately each major room. The RFID readers 200 and controllers 300 can then self-discover themselves and begin communications without the need to install any new wires. The present design of the RFID reader 200 employs the Intellon INT51X1 paired with an Ubicom processor to accomplish the power line communications 202. Other chipsets may be chosen, however without deducting from the present invention. However, as also discussed in the foregoing, there may be some users with higher security requirements that do not permit the use of power lines that may be shared with users outside of the building, and therefore the design permits the use of hardwired connections 209 between the controllers 300 and the RFID readers 200.

Each RFID reader 200 communicates with one or more RFID transponders 100 typically using modulated backscatter techniques. These techniques are very well understood by those skilled in the art, and have been well discussed in a plethora of literature including patent specifications, trade publications, marketing materials, and the like. For example, the reader is directed to *RFID Handbook, Radio-Frequency Identification: Fundamental And Applications,* by Klaus Finkenzeller, published by John Wiley, 1999. U.S. Pat. No. 6,147,605, issued to Vega et al, provides additional material on the design and theory of modulated backscatter techniques. Therefore, this same material is not covered here. Presently, a number of companies produce miniaturized chipsets, components, and antennas for RFID readers and transponders. Many of these chipsets, through designed for the 13.56 MHz band, are applicable and/or will be available in the higher bands such as those discussed here. For example, Hitachi has recently announced the manufacture of its mu-chip, which is an RFID tag measuring only 0.4 mm square. The most important point here is that the wide availability of parts permits the designer many options in choosing the specific design parameters of the RFID reader 200 and RFID transponder 100 and therefore the innovative nature of this invention is not limited to any specific circuit design implementing the wireless link between the RFID reader 200 and RFID transponder 100.

The extensive literature on RFID techniques and the wide availability of parts does not detract from the innovative application of these techniques and parts to the present invention. Most applications of RFID have been applied to mobile people, animals, or things that must be authorized, tracked, counted, or billed. No one has previously considered the novel application of low cost RFID components to solve the problem of monitoring fixed assets such as the windows and doors that comprise the openings of buildings.

All present transmitters constructed for wireless security systems are several times more expensive than the RFID-based design of the present invention. Furthermore, no one has considered the use of multiple, distributed low cost RFID reader 200 with overlapping coverage so that a building's security is not dependent on a single, vulnerable, and historically unreliable central transceiver.

There are several examples of the advantages that the present RFID approach offers versus present wireless security systems. Present wireless security systems limit status reporting by transmitters to times even longer than the FCC restriction of once per hour in order to conserve the battery in the transmitter. The RFID approach does not have the same battery limitation because of the modulated backscatter design. Present wireless security systems are subject to both false positive and false negatives indications because centrally located transceivers have difficulty distinguishing noise from real signals. The central transceiver has little control over the time of transmission by a transmitter and therefore must evaluate every signal, whether noise, interference, or real transmission. In contrast, the RFID approach places all of the transmission control in the master controller and RFID reader 200. The RFID reader 200 only looks for a reflected response 151 during a read 150. Therefore the RFID reader 200 can be simpler in design. Some centralized transceivers attempt to use diversity antennas to improve their reliability; however, these antennas are separated only by the width of the packaging, which is frequently less than one wavelength of the chosen frequency (i.e. 87 cm at 345 MHz and 69 cm at 433 MHz). As is well known to those skilled in the art of wireless, spatial diversity of antennas works best when the antennas are separated by more than one wavelength at the chosen frequency. With the present invention, RFID readers 200 are separated into multiple rooms, creating excellent spatial diversity and the ability to overcome environmental affects such as multipath and signal blockage.

One major design advantage of the present invention versus all other applications of RFID is the fixed relationship between each RFID reader 200 and the RFID transponders 100. While RFID readers 200 for other applications must include the complexity to deal with many simultaneous tags in the read zone, tags moving rapidly, or tags only briefly in the read zone, the present invention can take advantage of controlled static relationship in the following ways.

While there may be multiple RFID transponders 100 in the read zone of each RFID reader 200, the RFID reader 200 can poll each RFID transponder 100 individually, preventing collisions or interference.

Because the RFID transponders 100 are fixed, the RFID reader 200 can use longer integration times in its signal processing to increase the reliability of the read signal, permitting successful reading at longer distances and lower power when compared with RFID applications with mobile tags.

Furthermore, the RFID can attempt changes in specific frequency while remaining within the specified unlicensed frequency band, in an attempt to find, for each RFID transponder 100, an optimal center frequency, given the manufacturing tolerances of the components in each RFID transponder 100 and any environment effects that may be creating more absorption or reflection at a particular frequency.

Because the multiple RFID readers 200 are controlled from a single master controller, the controller 300 can sequence the RFID readers 200 in time so that the RFID readers 200 do not interfere with each other.

Because there will typically be multiple RFID readers 200 installed in each home, apartment, or other building, the controller 300 can use the excellent spatial diversity created by the distributed nature of the RFID readers 200 to increase and improve the reliability of each read. That is, one RFID reader 200 can imitate the transmission sequence 150, but multiple RFID readers 200 can tune and read the response 151 from the RFID transponder 100.

Because the RFID transponders 100 are static, and because the events (such as intrusion) that affect the status of the sensors connected to RFID transponders 100 are relatively slow compared to the speed of electronics in the RFID readers 200, the RFID readers 200 have the opportunity to pick and choose moments of low quiescent interference from other products in which to perform its reads with maximum signal to noise ration potential—all without missing the events themselves.

Because the path lengths and path loss from each RFID transponder 100 to the RFID reader 200 are relatively static, the RFID reader 200 can use different power levels when communicating with each RFID transponder 100. Lower path losses require lower power to communicate and conversely the RFID reader 200 can step up the power, within the specified limits of the FCC rules, to compensate for higher path losses. The RFID reader 200 can determine the lowest power level to use for each RFID transponder 100 by sequentially stepping down its transmit power 150 on successive reads until no return signal 151 can be detected. Then the power level can be increased one or two incremental levels. This determined level can then be used for successive reads. This use of the lowest necessary power level for each RFID transponder 100 can help reduce the possibility of interference while ensuring that each RFID transponder 100 can always be read.

Finally, for the same static relationship reasons, the RFID readers 200 can determine the typical characteristics of transmission between each RFID transponder 100 and each RFID reader 200 (such as signal power or signal to noise ratio), and determine from any change in the characteristics of transmission whether a potential problem exists.

By taking advantage of the foregoing techniques, the RFID reader 200 of the present invention has a demonstrated wireless range of between 10 and 30 meters (approximately a 10 dB range) when communicating with the RFID transponders 100, depending upon the building construction materials, placement of the RFID reader 200 in the room, and the furniture and other materials in the room which may have certain reflective or absorptive properties. This range is more than sufficient for the majority of homes and other buildings in the target market of the present security system, whereby the system can be implemented in a ratio of approximately one RFID reader 200 per major room (i.e. a hallway or foyer is not considered a major room for the purposes of the present discussion, but a living room or bedroom is a major room).

Figure 8B:
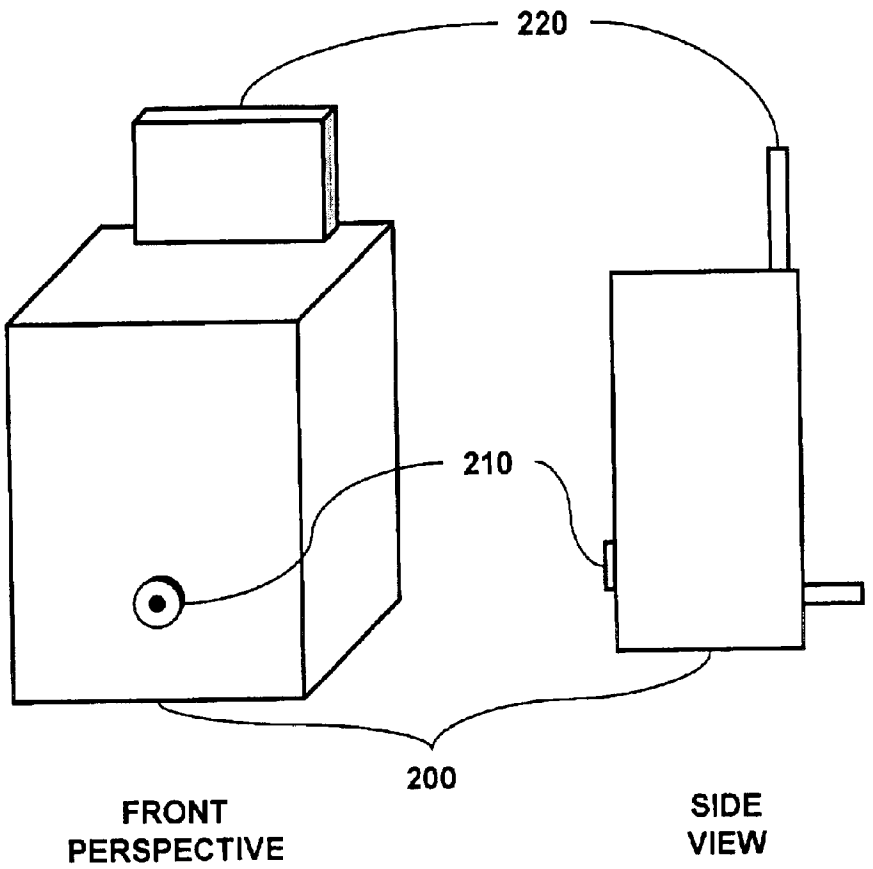
FIG. 8B shows an example embodiment of an RF reader with an acoustic transducer.

The RFID reader 200 is available with several options that increase the level of security in the inventive security system. One option enhances the RFID reader 200 to include an acoustic transducer 210 that adds glass breakage detection capability to the RFID reader 200. Glass breakage sensors have been widely available for years for both wired and wireless security systems. However, they are available only as standalone sensors selling for $40 or more. Of course, in a hardwired system, there is also the additional labor cost of installing separate wires from the alarm panel to the sensor. The cost of the sensors generally limits their use to just a few rooms in a house or other building. The cost, of course, is due to the need for circuits and processors dedicated to just analyzing the sound waves. Since the RFID reader 200 already contains a power supply 207, a processor 203, and a communications means back to the controller 300, the only incremental cost of adding the glass breakage detection capability is the addition of the acoustic transducer 210 (shown in FIGS. 8B and 9). With the addition of this option, glass breakage detection can be available in every room in which an RFID reader 200 has been installed.

Glass breakage detection is performed by analyzing received sound waves to look for the certain sound patterns distinct in the breaking of glass. These include certain high frequency sounds that occur during the impact and breaking of the glass and low frequencies that occur as a result of the glass flexing from the impact. The sound wave analysis can be performed by any number of widely known signal processing techniques that permit the filtering of received signals and determination of signal peaks at various frequencies over time.

One advantage of the present invention over older standalone glass breakage sensors is the ability to adjust parameters in the field. Because glass breakage sensors largely rely on the receipt of audio frequencies, they are susceptible to false alarms from anything that generates sounds at the right combination of frequencies. Therefore, there is sometimes a requirement that each glass breakage sensor be adjusted after installation to minimize the possibility of false alarms. In some cases, no adjustment is possible because algorithms are permanently stored in firmware at the time of manufacture. Because the glass breakage detection is performed by the RFID readers 200, which are all in communication with the controller 300, the controller 300 can alter or adjust parameters used by the RFID reader 200 in glass breakage detection. For example, the controller 300 can contain tables of parameters, each of which applies to different building construction materials or window types. The user can select the appropriate table entry during system configuration, or select another table entry later after experience has been gained with the installed security system. Furthermore, if the controller 300 has a modem module 305 or a wireless module 306, the controller 300 can contact an appropriate database that is, for example, managed by the manufacturing of the security system to obtain updated parameters. There is, therefore, significant advantage to this implementation of glass breakage detection, both in the cost of device manufacture and in the ability to make adjustments to the processing algorithms used to analyze the sound waves.

The addition of the acoustic transducer 210 to the RFID reader 200 for the glass breakage option also allows the RFID reader 200 to be used by an emergency response agency as a microphone to listen into the activities of an intruder. Rather than analyzing the sound waves, the sound waves can be digitized and send to the controllers 300, and then by the controllers 300 to the emergency response agency 374. After the controllers 300 have sent an alert message to the emergency response agency 374, an installed modem module 305 or wireless module 306 is available for use as an audio link, on either a dial-in or dial-out basis.

In a similar manner, the RFID reader 200 can contain optional algorithms for the sensing of motion in the room. Like glass breakage sensors, motion sensors are widely available as standalone devices. Prior art devices suffer from the same disadvantages cited for standalone glass breakage sensors, that is they are standalone devices requiring dedicated processors, circuits, and microwave generators. However, the RFID reader 200 already contains all of hardware components necessary for generating and receiving the radio wave frequencies commonly using in detecting motion; therefore the RFID reader 200 only requires the addition of algorithms to process the signals for motion in addition to performing its reading of the RFID transponders 100. Different algorithms are available for motion detection at microwave frequencies. One such algorithm is Doppler analysis. It is a well known physical phenomenon that objects moving with respect to a transmitter cause a reflection with a shift in the frequency of the reflected wave. While the shift is not large relative to the carrier frequency, it is easily detectable. This phenomenon applies to both sound waves and radio waves. Therefore, the RFID reader 200 can perform as a Doppler radar by the rapid sending and receiving of radio pulses, with the subsequent measurement of the reflected pulse relative to the transmitted pulse. People and animals walking at normal speeds with typically generate Doppler shifts of 5 Hz to 100 Hz, depending on the speed and direction of movement relative to the RFID reader 200 antenna. The RFID reader 200 is capable of altering its transmitted power to alter the detection range of this motion detection function.

These motion detection functions can occur simultaneously with the reading of RFID transponders 100. Because the RFID transponders 100 are fixed relative to the RFID readers 200, no unintended shift in frequency will occur in the reflected signal. Therefore, for each transmitted burst to an RFID transponder 100, the RFID reader 200 can analyze the reflected signal for both receipt of data from the RFID transponder 100 as well as unintended shifts in frequency indicating the potential presence of a person or animal in motion.

In summary, the RFID reader 200, in its fullest configuration in a single integrated package is capable of (i) communicating with the controller 300 using power line communications 202, (ii) communicating with RFID transponders 100 using wireless communications, (iii) detecting motion via Doppler analysis at microwave frequencies, (iv) detecting glass breakage via sound wave analysis of acoustic waves received via an audio transducer 210, and (v) providing an audio link to an emergency response agency 374 via an audio transducer 210 and via the controller 300. This RFID reader 200 achieves significant cost savings versus prior art security systems through the avoidance of new wire installation and the sharing of communicating and processing circuitry among the multiple functions. Furthermore, because the RFID readers 200 are under the control of a single master controller, the performance of these functions can be coordinated to minimize interference, and provide spatial diversity and redundant confirmation of received signals.

The motion detector implemented in the RFID reader 200 is only a single detection technology. Historically, single motion detection technologies, whether microwave, ultrasonic, or passive infrared, all suffer false positive indications. For example, a curtain being blown by a heating vent can occasionally be detected by a Doppler analysis motion detector. Therefore, dual technology motion detectors are sometimes used to increase reliability—for example by combining microwave Doppler with passive infrared so that motion by a warm body is required to trigger an alert. Because the RFID reader 200 will typically be mounted directly on power outlets 230, which are relatively low on the wall in most rooms, incorporating an infrared sensor in the RFID reader 200 is not a viable option. Passive infrared sensors lose their discriminating ability when their line of sight to a warm body is blocked. Because of the low mounting height of the RFID reader 200, it is likely that various pieces of furniture in the room will act to partially or fully block any view that a passive infrared sensor may have on the entire room. In order to overcome this potential limitation, the inventive security system implements a novel technique to implement dual technology motion sensing in a room without the requirement that both technologies be implemented into a single package.

Existing dual technology sensors implement both technologies into a single sensors because the sensors are only capable or reporting a "motion" or "no motion" condition to the alarm panel. This is fortunate, because present prior art alarm panels are only capable of receiving a "contact closed" or "contact open" indication. Therefore, all of the responsibility for identifying motion must exist within the single sensor package. The inventive security system can use power line carrier protocols to communicate with the RFID readers 200, and therefore can use the same power line carrier protocol to communicate with a passive infrared sensor mounted separately from the RFID reader 200. Therefore, if in a single room, the RFID reader 200 is detecting motion via microwave Doppler analysis and a passive infrared sensor 242 is detecting the presence of a warm body 350 as shown in FIG. 1, the master controller can interpret the combination of both of these indications in a single room as the likely presence of a person.

Figure 4A:
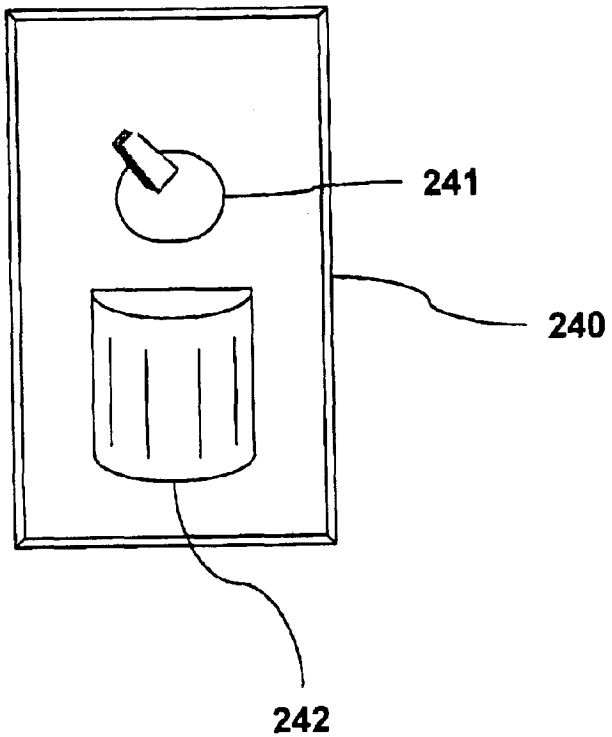
FIG. 4A shows an example embodiment of a passive infrared sensor integrated into a light switch.

The preferred embodiment of this passive infrared sensor 242 is in the form of a light switch 241 with cover 240 as shown in FIG. 4A. Most major rooms have at least one existing light switch, typically mounted at an average height of 55" above the floor. This mounting height is above the majority of furniture in a room, thereby providing a generally clear view of the room. Passive infrared sensors have previously been combined with light switches so as to automatically turn on the light when people are in room. More importantly, these sensor/switches turn off the lights when everyone has left, thereby saving electricity that would otherwise be wasted by lighting an unoccupied room. Because the primary purpose of these existing devices is to provide local switching, the devices cannot communicate with central controllers such as existing alarm panels.

The passive infrared sensor 242 that operates with the inventive security system includes power line carrier communications that permit the said sensor to communicate with one or more controllers 300, and be under control of the master controller. At the time of system installation, the master controller is configured by the user thereby identifying the rooms in which the RFID readers 200 are located and the rooms in which the passive infrared sensors 242 are located. The master controller can then associate each passive infrared sensor 242 with one or more RFID readers 200 containing microwave Doppler algorithms. The master controller can then require the simultaneous or near simultaneous detection of motion and a warm body, such as a person 350, before interpreting the indications as a probable person in the room.

Because each of the RFID readers 200 and passive infrared sensors 242 are under control of the master controller, portions of the circuitry in these devices can be shut down and placed into a sleep mode during normal occupation of the building. Since prior art motion sensors are essentially standalone devices, they are always on and are always reporting a "motion" or "no motion" condition to the alarm panel. Obviously, if the alarm panel has been placed into a disarmed state because, for example, the building is being normally occupied, then these "motion" or "no motion" conditions are simply ignored by the alarm panel. But the sensors continue to use power, which although the amount may be small, it is still a waste of power. Furthermore, it is well known in the study of reliability of electronic components that "power on" states generate heat in electronic components, and it is heat that contributes to component aging and possible eventual failure.

Additionally, there are some people concerned with being the in presence of microwave radiation. In reality, the amount of radiation generated by these devices is very small, and commonly believed to not be harmful to humans. However, there is the perception among some people that radiation of all types, however small, is still to be avoided. The present security system can selectively shut down the radiation from the RFID readers 200 when the security system is in a disarmed mode, or if the homeowner or building owner wants the security system to operate in a perimeter only mode without regard to the detection of motion. By shutting down the radiation and transmissions used for motion detection, the security system is conserving power, extending the potential life of the components, and reducing the possibility of interference between the RFID reader 200 and other products that may be operating in the same unlicensed band. This is advantageous because, for example, while people are occupying the building they may be using cordless telephones (or wireless LANs, etc.) and want to avoid possible interference from the RFID reader 200. Conversely, when the security system is armed, there are likely no people in the building, and therefore no use of cordless telephones, and the RFID readers 200 can operate with reduced risk of interference from the transmissions from said cordless telephones.

Figure 10:
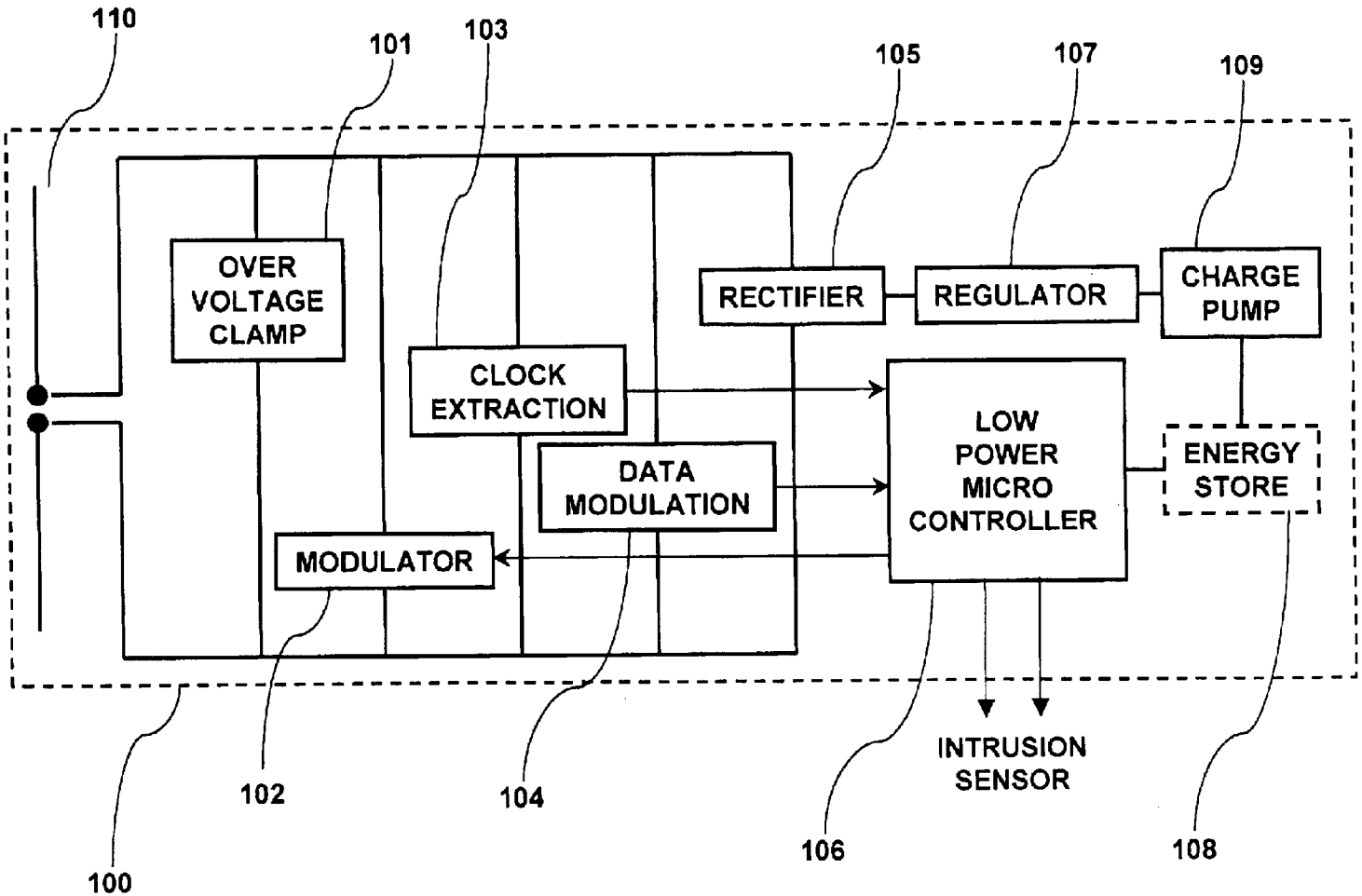
FIG. 10 shows the architecture of the RF transponder.

The RFID transponder 100 of the present invention is shown is FIG. 10, and is designed with an adhesive backing to enable easy attachment to the frame of an opening such as, for example, a window 353 frame or door 352 frame. RFID transponder designs based upon modulated backscatter are widely known and the details of transponder design are well understood by those skilled in the art. The RFID transponder 100 will typically include energy management circuits such as an overvoltage clamp 101 for protection, a rectifier 105 and regulator 107 to produce proper voltages for use by the charge pump 109 in charging the energy store 108 and powering the microprocessor 106. The RFID transponder 100 receives and interprets commands from the RFID reader 200 by including circuits for clock extraction 103 and data modulation 104. Furthermore, the microprocessor 106 can send data back and status back to the RFID reader 200 by typically using a modulator 102 to control the impedance of the antenna 110.

Furthermore, low cost chipsets and related components are available from a large number of manufacturers. In the present invention, the RFID reader 200 to RFID transponder 100 radio link budget is designed to operate at a maximum range of 10 to 30 meters. In a typical installation, each opening will have an RFID transponder 100 installed. The ratio of RFID transponders 100 to each RFID reader 200 will typically be 3 to 6 in an average residential home, although the technology of the present invention has no practical limit on this ratio. Those choice of addressing range is a designer's choice largely based on the desire to limit the transmission of wasted bits. Many RFID tags use 64 bits of addressing. There are RFID chipsets that can exchange thousands of bits. In practice, the present security system can likely suffice with as few as 8 bits. In order to increase the security of the transmitted bits, the RFID transponders 100 can include an encryption algorithm. The tradeoff is that this will increase the number of transmitted bits in each message.

The RFID transponders 100 are typically based upon a modulated backscatter design. Each RFID transponder 100 in a room absorbs power radiated 150 from one or more RFID readers 200 when the said RFID transponder 100 is being addressed, as well as when other RFID transponders 100 are being addressed. In addition, the RFID readers 200 can radiate power 150 for the purpose of providing energy for absorption by the RFID transponders 100 even when the RFID reader 200 in not interrogating any RFID transponders 100. Therefore, unlike most RFID applications in which the RFID transponders 100 or tags are mobile and in the read zone of the RFID reader 200 briefly, the RFID transponders 100 of the present invention are fixed relative to the RFID readers 200 and therefore always in the read zone of at least one RFID reader 200. Therefore, the said RFID transponders 100 have extremely long periods of time in which to absorb, integrate, and store transmitted energy. Because of the passive nature of the RFID transponder 100, the transfer of energy in which to power the tag relies on the buildup of electrostatic charge across the antenna elements 110 of the RFID transponder 100. As the distance increases between the RFID reader 200 and the RFID transponder 100, the potential voltage that can develop across the antenna elements declines. For example, under 47 CFR 15.245 the RFID reader 200 can transmit up to 75 mW. At a distance of 10 m, this transmitted power generates a field of 150 mV/m and at a distance of 30 m, the field is 50 mV/m.

Therefore, the RFID transponder 100 include a charge pump 109 in which to incrementally add the voltages developed across several capacitors together to produce higher voltages necessary to power the various circuits contained with the RFID transponder 100. Charge pump circuits for boosting voltage are well understood by those skilled in the art.

One form of the RFID transponder 100 can contain a battery 108, such as a button battery (most familiar use is as a watch battery) or a thin film battery. Batteries of these shapes can be based upon various lithium compounds that provide very long life. For example, Cymbet has developed a thin film battery that is both long life and can be recharged at least 70,000 times. The use of the battery in the RFID transponder 100 doesn't change the use the passive modulated backscatter techniques as the communications means. Rather, the battery 108 is used to enhance and assist in the powering of the various circuits in the RFID transponder 100. Therefore, rather than relying solely on a limited energy store 108 such as a capacitor, the RFID transponder 100 can be assured of always having sufficient energy through a longer life battery component. If order to preserve charge in the battery 108, the processor 106 of the RFID transponder 100 can place some of the circuits in the RFID transponder 100 into temporary sleep mode during periods of inactivity.

As mentioned above, the RFID transponder 100 contains a charge pump 109 with which the RFID transponder 100 can build up voltages and stored energy with which to regularly recharge the battery 108, if present. If the battery were to be recharged once per day, a battery capable of being recharged 70,000 times provides a life of over 190 years. This is in stark contrast with the battery powered transmitters used in prior art wireless security systems, which have a typical life of 1 to 2 years.

In addition to the charge pump 109 for recharging the battery 108, the RFID transponder 100 contains circuits for monitoring the charged state of the battery 108. If the battery 108 is already fully charged, the RFID transponder 100 can signal the RFID reader 200 using one or more bits in a communications message. Likewise, if the battery 108 is less than fully charged, the RFID transponder 100 can signal the RFID reader 200 using one or more bits in a communications message. Using the receipt of these messages regarding the state of the battery 108, if present, in each RFID transponder 100, the RFID reader 200 can take actions to continue with the transmission of radiated power, increase the amount of power radiated (obviously while remaining within prescribed FCC limits), or even suspend the transmission of radiated power if no RFID transponder 100 requires power for battery charging. By suspending unnecessary transmissions, the RFID reader 200 can conserve wasted power and reduce the likelihood of causing unwanted interference.

Each RFID transponder 100 is typically connected to at least one intrusion sensor 120. From a packaging standpoint, the present invention also includes the ability to combine the intrusion sensors 120 and the RFID transponder 100 into a single package, although this is not a requirement of the invention. The intrusion sensor 120 is used to detect the passage, or attempted passage, of an intruder through an opening in a building, such as window 353 or door 352. In a typical form, the intrusion sensor 120 may simply detect the movement of a portion of a window 353 or door 352. This may be accomplished, for example, by the use of a miniature magnet on the movable portion of the window 353 or door 352, and the use of a magnetically actuated miniature reed switch on a fixed portion of the window 353 or door 352. Other forms are also possible. For example, a pressure sensitive contact may be used whereby the movement of the window 353 or door 352 relieves the pressure on the contact, changing its state. The pressure sensitive contact may be mechanical or electro-mechanical such as a MEMS device. In any of these cases, the contact of the intrusion sensor 120 is connected to, or incorporated into, the RFID transponder 100 such that the state of "contact closed" or "contact open" can be transmitted by the RFID transponder 100 in a message to the RFID reader 200.

Because the RFID transponder 100 is a powered device (without or without the battery, the RFID transponder 100 can receive and store power), and the RFID reader 200 makes radiated power available to any device capable of receiving its power, other forms of intrusion sensor 120 design are also available. For example, the intrusion sensor 120 can itself be a circuit capable of limited radiation reflection. Under normally closed circumstances, the close location of this intrusion sensor 120 to the RFID transponder 100 and the simultaneous reflection of RF energy can cause the generation of harmonics detectable by the RFID reader 200. When the intrusion sensor 120 is moved due to the opening of the window 353 or door 352, the gap between the intrusion sensor 120 and the RFID transponder 100 will increase, thereby reducing or ceasing the generation of harmonics. Alternately, the intrusion sensor 120 can contain metal or magnetic components that act to tune the antenna 110 or frequency generating components of the RFID transponder 100 through coupling between the antenna 110 and the metal components, or the switching in/out of capacitors or inductors in the tuning circuit. When the intrusion sensor 120 is closely located next to the RFID transponder 100, one form of tuning is created and detected by the RFID reader 200. When the intrusion sensor 120 is moved due to the opening of the window 353 or door 352, the gap between the intrusion sensor 120 and the RFID transponder 100 will increase, thereby creating a different form of tuning within the RFID transponder 100 which can also be detected by the RFID reader 200. The intrusion sensor 120 can also be an RF receiver, absorbing energy from the RF reader, and building an electrostatic charge upon a capacitor using a charge pump, for example. The increasing electrostatic charge will create a electric field that is small, but detectable by a circuit in the closely located RFID transponder 100. Again, when the intrusion sensor 120 is moved, the gap between the intrusion sensor 120 and the RFID transponder 100 will increase, causing the RFID transponder 100 to no longer detect the electric field created by the intrusion sensor 120.

In each of the cases, the RFID transponder 100 is acting with a connected or associated intrusion sensor 120 to provide an indication to the RFID reader 200 that an intrusion has been detected. The indication can be in the form of message from the RFID transponder 100 to the RFID reader 200, or in the form of a changed characteristics of the transmissions from the RFID transponder 100 such that the RFID-reader 200 can detect the changes in the characteristics of the said transmission. It is impossible to know which form of intrusion sensor 120 will become most popular with users of the inventive security system, and therefore the capability for multiple forms has been designed into the system. Therefore, the inventive nature of the security system and the embodiments disclosed herein is not limited to any single combination of intrusion sensor 120 technique and RFID transponder 100.

The RFID reader 200 is not limited to reading just the RFID transponders 100 installed in the openings of the building. The RFID reader 200 can also read RFID tags that may be carried by individuals or animals 351, or placed on objects of high value. By placing an RFID tag on an animal 351, for example, the controller 300 can optionally ignore indications received from the motion sensors if the animal 351 is in the room where the motion was detected. By placing an RFID tag on a child, the controller 300 can use the wireless module 306, if installed, to send an SMS-based message to a parent at work when the child has arrived home. The RFID tag can also include a button than can be used, for example, by an elderly or invalid person to call for help in the event of a medical emergency or other panic condition. Because the RFID readers 200 will typically be distributed throughout a house, this form of panic button can provide a more reliable radio link than older systems with only a single centralized receiver.

Earlier, the X-10 power line protocol was mentioned and then dismissed as a contender for use in the power line communications of the disclosed invention. The X-10 protocol is far too simple and lacking in reliability features for use in a security system. However, there is reportedly over 100 million lighting and appliance control devices that have shipped with the X-10 protocol. These devices are typically used only to turn on, turn off, or variably dim lights or appliances. Because the controller 300 is already coupled to the power lines 250, the controller 300 is also capable of generating the 120 KHz pulses necessary to send X-10 based commands to X-10 devices that may be installed in the building or home. The controller 300 can be configured, for example, to turn on certain lights when an intrusion has been detected and when the system has been disarmed. The support for this protocol is only as a convenience for these legacy devices.

Finally, the security system also includes an optional legacy interface module 400 shown in FIG. 2. This module 400 can be used by building owners or homeowners that already have certain parts of a prior art wired security system installed, and would like to continue to use these parts in conjunction with the inventive security system disclosed herein. Older wired security systems operate on the contact "closed" or "open" principle. That is, each sensor, whether magnetic/reed switch window/door contact, motion sensor, glass breakage sensor, heat sensor, etc., is in one state (generally contact "closed") when normal, and then is the other state (generally contact "open") when in the detection state (i.e. intrusion, motion, heat, etc.). The legacy interface module 400 allows these legacy devices to be monitored by the controller 300. The legacy interface module 400 provides power line communications 402 to the controller 300, terminal interfaces 401 for the wires associated with the sensors, 12 volt DC power 402 to powered devices, and battery 403 backup in the case of loss of primary power. The controller 300 must be configured by the user to interpret the inputs from these legacy devices.

The true scope of the present invention is not limited to the presently preferred embodiments disclosed herein. As will be understood by those skilled in the art, for example, different components, such as processors or chipsets, can be chosen in the design, packaging, and manufacture of the various elements of the present invention. The discussed embodiments of the present invention have generally relied on the availability of commercial chipsets, however, many of the functions disclosed herein can also be implemented by a designer using discrete circuits and components. As a further example, the RFID reader 200 and RFID transponder 100 can operate at different frequencies than those discussed herein, or the controller 300 and RFID reader 200 can use alternate power line communications protocols. Also, certain functions which have been discussed as optional may be incorporated as part of the standard product offering if customer purchase patterns dictate certain preferred forms. Finally, this document generally references US standards, custom, and FCC rules. Various parameters, such as input power or output power, for example, can be adjusted to conform with international standards. According, except as they may be expressly so limited, the scope of protection of the following claims is not intended to be limited to the specific embodiments described above.

I claim:

1. A security system for use in a building with at least a first opening to be monitored for intrusion, said security system comprising:

at least a first controller and a second controller, at least a first intrusion sensor monitoring at least the first opening, said first intrusion sensor being connected to a first RFID transponder, at least a first RFID reader in wireless communications with at least said first RFID transponder, and in communications with at least the first controller, wherein said first controller and said second controller both receive communications from said RFID reader indicating whether said intrusion sensor has detected an intrusion, and wherein said first controller and said second controller contain arbitration logic to determine which of said first controller and said second controller will in turn cause an alert indicating that said intrusion sensor has detected an intrusion.

2. The security system of claim 1, wherein said first RFID transponder includes a battery to power at least a portion of circuits included in said first RFID transponder.

3. The security system of claim 1, wherein said first RFID reader communicates with at least said first controller using a power line carrier protocol.

4. The security system of claim 1, further comprising:

a second intrusion sensor monitoring a second opening, said second intrusion sensor being connected to a second RFID transponder, wherein the first RFID reader is in wireless communications with both said first RFID transponder and second RFID transponder, and wherein at least said first controller is configured to receive communications from the RFID reader indicating which of said intrusion sensors have detected an intrusion.

5. The security system of claim 1, wherein at least said first controller is configured to cause an alert by sending a message to at least one emergency response agency using a public switched telephone network.

6. The security system of claim 1, wherein at least said first controller is configured to cause an alert by sending a message to at least one emergency response agency using at least one commercial mobile radio service.

7. The security system of claim 1, wherein said first RFID reader is configured to communicate with at least said first controller using a hardwired connection.

8. The security system of claim 1, wherein said first RFID reader includes means for transferring power to said first RFID transponder using radio waves.

9. The security system of claim 2, wherein said first RFID transponder includes means for receiving power from radio waves, means for converting the power received from the radio waves, and means for using the converted power to charge the battery.

10. The security system of claim 8, wherein said first RFID reader is configured to switch its means for transferring power to one or more of said RFID transponders on and off.

11. The security system of claim 8, wherein said first RFID reader is configured to receive a status message from at least one RFID transponder, said status message comprising at least a single bit and indicating whether said at least one RFID transponder requires power for charging a battery of said at least one RFID transponder.

12. The security system of claim 2, wherein said first RFID transponder includes—means for conserving stored energy in the battery by placing at least a portion of said RFID transponder into a sleep mode during periods of inactivity.

13. The security system of claim 1, wherein said first RFID reader includes an acoustic transducer, coupled with algorithms, capable of detecting the breakage of glass.

14. The security system of claim 1, wherein said first RFID reader also contains an acoustic transducer capable of receiving sound waves, and a means for sending said sound waves to at least the first controller.

15. The security system of claim 1, wherein said first RFID reader includes a processing apparatus and algorithms using microwave Doppler analysis configured to detect motion.

16. The security system of claim 1, wherein said first RFID reader is in wireless communications with an RFID tag carried by a person or animal or placed on an object.

17. The security system of claim 1, including an interface module containing means whereby at least one of the first controller and the second controller can monitor a contact "closed" or "open" status of at least one wired sensor.

18. The security system of claim 1, wherein at least one of the first controller and the second controller is in communications with at least one passive infrared sensor using a power line communications protocol.

19. An RFID reader for use in a security system that monitors a building for possible intrusion, said RFID reader comprising:

means for communicating with at least a first controller and a second controller in a security system capable of causing an alert, wherein said first controller and said second controller contain arbitration logic to determine which of said first controller and said second controller will cause an alert indicating that an intrusion sensor has detected an intrusion, means for communicating with at least a first RFID transponder using wireless communication, logic, implemented in either firmware of software, for receiving a message from at least said first RFID transponder indicating whether the intrusion sensor has detected an intrusion, and logic, implemented in either firmware or software, for sending a message to at least said first controller and said second controller of the security system indicating whether the intrusion sensor has detected an intrusion.

20. The RFID reader of claim 19, wherein the RFID reader includes means for transferring power to one or more RFID transponders using radio waves for charging batteries, if present, in said one or more RFID transponders.

21. The RFID reader of claim 20, wherein the RFID reader is configured to switch said means for transferring power to said one or more RFID transponders using radio waves on and off.

22. The RFID reader of claim 21, wherein the RFID reader receives a status message from at least one of said RFID transponders comprising at least a single bit, wherein the status message indicates whether said at least one RFID transponder requires power for charging a battery of said at least one RFID transponder.

23. The RFID reader of claim 19, wherein the RFID reader communicates with at least said first controller using a power line carrier protocol.

24. The RFID reader of claim 19, wherein the RFID reader communicates with at least said first controller using a hardwired connection.

25. The RFID reader of claim 19, wherein the RFID reader comprises an acoustic transducer, coupled with algorithms, capable of detecting the breakage of glass.

26. The RFID reader of claim 19, wherein the RFID reader comprises an acoustic transducer capable of receiving sound waves, and a means for sending said sound waves to at least one of said first and second controllers.

27. The RFID reader of claim 19, wherein the RFID reader comprises a processing apparatus and algorithms for using microwave Doppler analysis to detect motion.

28. The RFID reader of claim 19, wherein the RFID reader is in wireless communications with an RFID tag carried by a person or animal or placed on an object.

29. A method of monitoring intrusion in a building comprising at least a first opening, said method comprising the steps of:

detecting an intrusion with at least a first intrusion sensor, receiving a message from at least a first RFID transponder at a first RFID reader indicating that said intrusion sensor has detected the intrusion, receiving a message at at least a first and a second controller from at least said first RFID reader indicating that said first intrusion sensor has detected the intrusion, determining, using arbitration logic, which of said first controller and said second controller will cause an alert indicating that said first intrusion sensor has detected the intrusion, and causing the alert.

30. The method of claim 29, wherein at least one of said first controller and said second controller causes the alert by sending a message to at least one emergency response agency using at least one commercial mobile radio service.

31. The method of claim 29, wherein at least one of said first controller and said second controller causes the alert by sending a message to at least one emergency response agency using a public switched telephone network.

32. The method of claim 29, wherein the first RFID reader sends its message to said first controller and said second controller using a power line carrier protocol.

* * * * *

UNITED STATES PATENT AND TRADEMARK OFFICE

CERTIFICATE OF CORRECTION

PATENT NO. : 6,888,459 B2
DATED : May 3, 2005
INVENTOR(S) : Louis A. Stilp

It is certified that error appears in the above-identified patent and that said Letters Patent is hereby corrected as shown below:

Title page,
Item [56], References Cited, U.S. PATENT DOCUMENTS, please insert the following:

| | | |
|---|---|---|
| -- 2002/0070863 | 6/13/02 | Brooking |
| 2002/0174367 | 11/21/02 | Kimmel et al. |
| 2003/0227385 | 12/11/03 | Lancaster |
| 2004/0008112 | 1/15/04 | Carrender |
| 2004/0046642 | 3/11/04 | Becker et al. |
| 2004/0066280 | 4/8/04 | Pratt et al. |
| 2004/0210495 | 10/21/01 | White |
| 4,465,904 | 8/14/84 | Gottsegen et al. |
| 4,550,311 | 10/29/85 | Galloway et al. |
| 4,724,425 | 2/9/88 | Gerhart et al. |
| 4,731,810 | 3/15/88 | Watkins |
| 4,754,261 | 6/28/88 | Marino |
| 4,812,820 | 3/14/89 | Chatwin |
| 4,855,713 | 8/4/89 | Brunius |
| 4,908,604 | 3/13/90 | Jacob |
| 4,951,029 | 8/21/90 | Severson |
| 4,980,913 | 12/25/90 | Skret |
| 5,040,335 | 8/20/91 | Grimes |
| 5,233,640 | 8/3/93 | Kostusiak |
| 5,300,875 | 4/5/94 | Tuttle |
| 5,307,763 | 5/3/94 | Arthur et al. |
| 5,406,263 | 4/11/95 | Tuttle |
| 5,438,607 | 8/1/95 | Przygoda, Jr. et al. |
| 5,465,081 | 11/7/95 | Todd |
| 5,543,778 | 8/6/96 | Stouffer |
| 5,621,662 | 4/15/97 | Humphries et al. |
| 5,625,338 | 4/29/97 | Pildner et al. |
| 5,646,592 | 7/8/97 | Tuttle |
| 5,649,296 | 7/15/97 | MacLellan et al. |
| 5,668,929 | 9/16/97 | Foster, Jr. |
| 5,706,399 | 1/6/98 | Bareis |
| 5,726,644 | 3/10/98 | Jednacz et al. |
| 5,736,927 | 4/7/98 | Stebbins et al. |
| 5,742,237 | 4/21/98 | Bledsoe |
| 5,748,079 | 5/5/98 | Addy |
| 5,761,206 | 6/2/98 | Kackman |
| 5,786,767 | 7/28/98 | Severino |
| 5,799,062 | 8/25/98 | Lazzara et al. |
| 5,801,626 | 9/1/98 | Addy |
| 5,805,063 | 9/8/98 | Kackman |
| 5,805,064 | 9/8/98 | Yorkey |
| 5,809,013 | 9/15/98 | Kackman |

UNITED STATES PATENT AND TRADEMARK OFFICE

CERTIFICATE OF CORRECTION

PATENT NO. : 6,888,459 B2
DATED : May 3, 2005
INVENTOR(S) : Louis A. Stilp

It is certified that error appears in the above-identified patent and that said Letters Patent is hereby corrected as shown below:

Title page (cont'd),

| | | |
|---|---|---|
| 5,812,054 | 9/22/98 | Cohen |
| 5,822,373 | 10/13/98 | Addy |
| 5,828,300 | 10/27/98 | Addy et al. |
| 5,831,531 | 11/3/98 | Tuttle |
| 5,889,468 | 3/30/99 | Banga |
| 5,894,266 | 4/13/99 | Wood, Jr. et al. |
| 5,898,369 | 4/27/99 | Godwin |
| 5,905,438 | 5/18/99 | Weiss et al. |
| 5,907,279 | 5/25/99 | Bruins et al. |
| 5,920,270 | 7/6/99 | Peterson |
| 5,929,778 | 7/27/99 | Asama et al. |
| 5,949,335 | 9/7/99 | Maynard |
| 5,950,110 | 9/7/99 | Hendrickson |
| 6,026,165 | 2/15/00 | Marino et al. |
| 6,028,513 | 2/22/00 | Addy |
| 6,049,273 | 4/11/00 | Hess |
| 6,054,925 | 4/25/00 | Proctor et al. |
| 6,058,137 | 5/2/00 | Partyka |
| 6,060,994 | 5/9/00 | Chen |
| 6,078,269 | 6/20/00 | Markwell et al. |
| 6,084,530 | 7/4/00 | Pidwerbetsky et al. |
| 6,087,933 | 7/11/00 | Addy et al. |
| 6,104,785 | 8/15/00 | Chen |
| 6,120,262 | 9/19/00 | McDonough et al. |
| 6,127,928 | 10/3/00 | Issacman et al. |
| 6,134,303 | 10/17/00 | Chen |
| 6,137,402 | 10/24/00 | Marino |
| 6,150,936 | 11/21/00 | Addy |
| 6,163,257 | 12/19/00 | Tracy |
| 6,175,860 | 1/16/01 | Gaucher |
| 6,177,861 | 1/23/01 | MacLellan et al. |
| 6,191,701 | 2/20/01 | Bruwer |
| 6,195,006 | 2/27/01 | Bowers et al. |
| 6,208,247 | 3/27/01 | Agre et al. |
| 6,208,694 | 3/27/01 | Addy |
| 6,215,404 | 4/10/01 | Morales |
| 6,229,997 | 5/8/01 | Addy |
| 6,236,315 | 5/22/01 | Helms |
| 6,243,010 | 6/5/01 | Addy et al. |
| 6,243,012 | 6/5/01 | Shober et al. |
| 6,252,501 | 6/26/01 | Tice et al. |
| 6,255,944 | 7/3/01 | Addy |

UNITED STATES PATENT AND TRADEMARK OFFICE

CERTIFICATE OF CORRECTION

PATENT NO. : 6,888,459 B2
DATED : May 3, 2005
INVENTOR(S) : Louis A. Stilp

It is certified that error appears in the above-identified patent and that said Letters Patent is hereby corrected as shown below:

Title page (cont'd),

| | | |
|---|---|---|
| 6,271,754 | 8/8/01 | Durtler |
| 6,285,261 | 9/4/01 | Pax et al. |
| 6,294,992 | 9/25/01 | Addy et al. |
| 6,313,743 | 11/6/01 | Abraham-Fuchs et al. |
| 6,317,028 | 11/13/01 | Valiulis |
| 6,366,215 | 4/2/02 | Tice et al. |
| 6,367,697 | 4/9/02 | Turner et al. |
| 6,377,609 | 4/23/02 | Brennan, Jr. |
| 6,441,723 | 8/27/02 | Mansfield, Jr. et al. |
| 6,441,731 | 8/27/02 | Hess |
| 6,445,291 | 9/3/02 | Addy et al. |
| 6,445,292 | 9/3/02 | Jen et al. |
| 6,456,668 | 9/24/02 | MacLellan et al. |
| 6,459,726 | 10/1/02 | Ovard et al. |
| 6,466,138 | 10/25/02 | Partyka |
| 6,483,433 | 11/19/02 | Moskowitz et al. |
| 6,501,807 | 12/31/02 | Chieu et al. |
| 6,507,607 | 1/14/03 | Hill |
| 6,593,845 | 7/15/03 | Friedman et al. |
| 6,646,550 | 11/11/03 | Runyon et al. |
| 6,691,172 | 2/10/04 | Clow et al. |
| 6,703,930 | 3/9/04 | Skinner |
| 6,707,374 | 3/16/04 | Zaharia |
| 6,806,808 | 10/19/04 | Watters et al. |

Signed and Sealed this

Fifteenth Day of November, 2005

JON W. DUDAS
*Director of the United States Patent and Trademark Office*